US011684809B2

(12) United States Patent
Salvino et al.

(10) Patent No.: US 11,684,809 B2
(45) Date of Patent: Jun. 27, 2023

(54) ANTI-CONTAGION MASK

(71) Applicants: Chris Salvino, Scottsdale, AZ (US); Keir Hart, Lafayette, CO (US); Kenneth Altshuler, Longmont, CO (US)

(72) Inventors: Chris Salvino, Scottsdale, AZ (US); Keir Hart, Lafayette, CO (US); Kenneth Altshuler, Longmont, CO (US)

(73) Assignee: SharpMed, LLC., Scottsdale, AZ (US)

( * ) Notice: Subject to any disclaimer, the term of this patent is extended or adjusted under 35 U.S.C. 154(b) by 287 days.

(21) Appl. No.: 17/115,543

(22) Filed: Dec. 8, 2020

(65) Prior Publication Data

US 2021/0290988 A1 Sep. 23, 2021

Related U.S. Application Data

(63) Continuation of application No. 17/114,414, filed on Dec. 7, 2020, now Pat. No. 11,123,581.

(60) Provisional application No. 63/031,745, filed on May 29, 2020, provisional application No. 62/992,903, filed on Mar. 20, 2020.

(51) Int. Cl.

| | |
|---|---|
| ***A62B 7/10*** | (2006.01) |
| ***A62B 18/02*** | (2006.01) |
| ***A41D 13/11*** | (2006.01) |
| ***A62B 18/08*** | (2006.01) |
| ***A62B 23/02*** | (2006.01) |

(52) U.S. Cl.

CPC ..... *A62B 7/10* (2013.01); *A41D 13/1138* (2013.01); *A62B 18/025* (2013.01); *A62B 18/084* (2013.01); *A62B 23/02* (2013.01)

(58) Field of Classification Search

CPC ..... A62B 18/02; A62B 18/025; A62B 23/02; A62B 7/10; A41D 13/1138; A41D 13/1146

See application file for complete search history.

(56) References Cited

U.S. PATENT DOCUMENTS

| | | | | |
|---|---|---|---|---|
| 1,491,674 A * | 4/1924 | Coletti | ..... | A41D 13/1192 128/206.13 |
| 3,500,825 A | 3/1970 | Andersson et al. | | |
| 4,296,746 A | 10/1981 | Mason et al. | | |
| 4,323,063 A * | 4/1982 | Fisichella | ..... | A41D 13/1146 128/863 |
| 4,467,799 A | 8/1984 | Steinberg | | |
| 4,503,851 A | 3/1985 | Braunroth | | |

(Continued)

*Primary Examiner* — Valerie L Woodward

(74) *Attorney, Agent, or Firm* — Kenneth Altshuler

(57) ABSTRACT

The disclosed anti-contagion facemask embodiments are a family of transparent facemasks that do not obstruct visibility of a person's mouth when worn. One problem with a typical, widely used, facemask is the difficulty in understanding a person speaking when they are wearing the typical facemask. Not only does the listener have to contend with the muffled speech of a person talking through a facemask, communication is made worse by covering up, or otherwise hiding the wearer's mouth and face with opaque filter material. Accordingly, some embodiments described herein present a clear/see-through filtration mask embodiment that does not visibly obstruct a person's mouth by providing a filtration system along or near the periphery of the facemask.

20 Claims, 27 Drawing Sheets

(56) References Cited

U.S. PATENT DOCUMENTS

| | | | | |
|---|---|---|---|---|
| 5,636,628 | A | 6/1997 | Barnum | |
| 6,173,712 | B1 | 1/2001 | Brunson | |
| 7,802,572 | B2 | 9/2010 | Hahne | |
| 2006/0230485 | A1* | 10/2006 | Lee | A41D 13/1138 2/15 |
| 2018/0256926 | A1* | 9/2018 | Kyung | A62B 18/10 |

* cited by examiner

ANTI-CONTAGION MASK

CROSS-REFERENCE TO RELATED APPLICATIONS

This application claims priority to and the benefit of U.S. patent application Ser. No. 17/114,414 entitled: Anti-Contagion Mask, filed on Dec. 7, 2020, which claims priority to 1) U.S. Provisional Patent Application No. 62/992,903 entitled: Anti-Contagion Mask, filed on Mar. 20, 2020, and 2) U.S. Provisional Patent Application No. 63/031,745 entitled: Anti-Contagion Mask, filed on May 29, 2020.

FIELD OF THE INVENTION

The present embodiments are directed to a transparent anti-contagion facemask.

BACKGROUND OF THE INVENTION

The World Health Organization and most medical professionals agree that facemasks are an effective way to reduce transmission of airborne pathogens that cause respiratory illness. There are a variety of different facemasks from N-95 facemasks, constructed with facemask material that filters out 95% of 0.3 μm particles, to simple cloth and surgical facemasks that somewhat block moisture particles from a person's exhalant. Though protective, present day facemasks tend to muffle the sound of a person's speech making them hard to understand.

It is to innovations related to this subject matter that the claimed invention is generally directed.

SUMMARY OF THE INVENTION

The present embodiments are directed to facemasks with some embodiments directed to transparent anti-contagion facemasks that do not obstruct visibility of a person's mouth when worn. One problem with a typical, widely used, facemask is the difficulty in understanding a person speaking when they are wearing the typical facemask. Not only does the listener have to contend with the muffled speech of a person talking through a facemask, communication is made worse by covering up, or otherwise hiding, the wearer's mouth and face with opaque filter material. Certain embodiments of the present invention aim to address this problem and others by way of a clear/see-through filtration mask embodiment that does not visibly obstruct a person's mouth. Coupling an adequate filtration material with the transparent facemask, one object of the present invention seeks to improve protection against airborne viruses compared to a simple cloth facemask. Though embodiments of the transparent facemask may not eliminate the muffled speech of a person talking while wearing the transparent facemask, communication is certainly improved by virtue of seeing the wearer's face while they are speaking.

With this in mind, certain embodiments of the present invention therefore contemplate a passive transparent facemask comprising: a face covering cup configured to cover a mouth and nostrils of a wearer with a mask midpoint defined as a point on the face covering cup that is equidistant between the mouth and the nostrils when the facemask is worn, the face covering cup is defined by a cup periphery that is further defined by a nose periphery region adapted to traverse the bridge of a nose of the wearer, a pair of cheek periphery regions adapted to traverse along cheeks of the wearer and a chin periphery region adapted to traverse along or above a jawline of the wearer, the face covering cup further defining a midline that bisects the face covering cup midway between the nose periphery region and the chin periphery region; a plurality of breathing perforations dispersed in the face covering cup at a distance greater than 1.25 inches from the midpoint; and at least one filter that covers the breathing perforations. Exchange of air can essentially only occur through the breathing perforations via the at least one filter.

Yet another embodiment of the present invention envisions a passive transparent respirator assembly comprising: a transparent face covering cup comprising a nose covering region configured to cover human nostrils and at least a portion of a human nose, a mouth covering region configured to completely cover a human mouth without any external viewable obstruction to the human mouth when the human mouth is closed, a chin covering region configured to cover at least a portion of a human chin, and two cheek covering regions located on either side of a midline and configured to cover a portion of a human cheek, the midline is defined as bisecting the face covering cup extending along and bisecting the nose covering region and the chin covering region, the face covering cup is unitary, the face covering cup is further defined by a cup exterior surface and a cup interior surface; at least one aperture extending through the face covering cup from the cup exterior surface to the cup interior surface, the at least one aperture covered by at least one filter, which together comprise a passive respirator intake pathway, there is no other pathway other than the passive respirator intake pathway between the cup exterior surface and the interior surface.

BRIEF DESCRIPTION OF THE DRAWINGS

FIG. 1H is a drawing executed in color. Copies of this patent or patent application publication with color drawing(s) will be provided by the Office upon request and payment of the necessary fee;

DETAILED DESCRIPTION

Figure 1A:
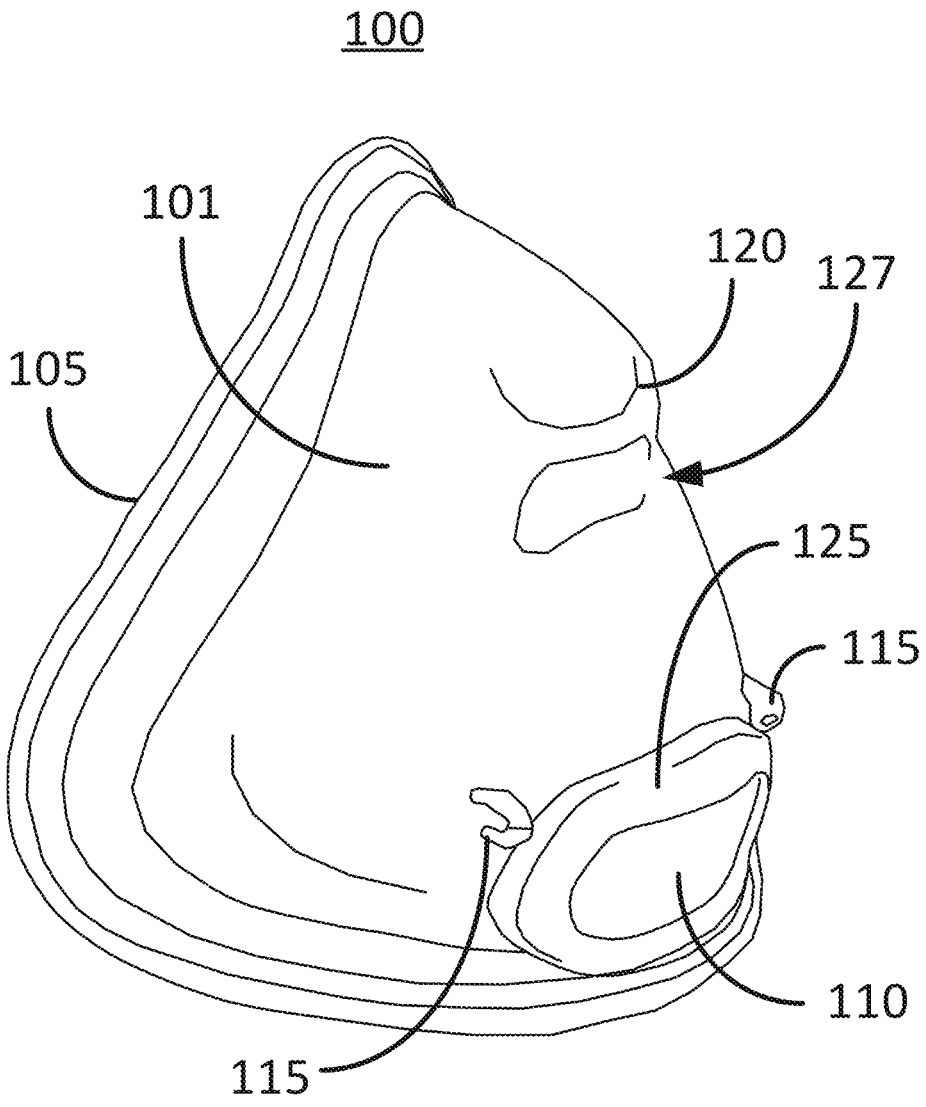
FIGS. 1A-1G are line drawings depicting various views of at least one facemask embodiment consistent with embodiments of the present invention.

Initially, this disclosure is by way of example only, not by limitation. Thus, although the instrumentalities described herein are for the convenience of explanation, shown and described with respect to exemplary embodiments, it will be appreciated that the principles herein may be applied equally in other types of situations involving similar uses of transparent facemasks. The phrases "in one embodiment," "according to one embodiment," and the like generally mean the particular feature, structure, or characteristic following the phrase is included in at least one embodiment of the present invention, and may be included in more than one embodiment of the present invention. Importantly, such phases do not necessarily refer to the same embodiment. If the specification states a component or feature "may", "can", "could", or "might" be included or have a characteristic, that particular component or feature is not required to be included or have the characteristic. In what follows, similar or identical structures may be identified using identical callouts.

Certain embodiments of the present invention are directed to transparent anti-contagion facemasks that do not obstruct visibility of a person's mouth when worn. One problem with a typical, widely used facemask is the difficulty in understanding a person speaking when they are wearing the typical facemask. Not only does the listener have to contend with the muffled speech of a person talking through a facemask, communication is made worse by covering up, or otherwise hiding the wearer's mouth and face with opaque filter material. Accordingly, some embodiments described herein present a clear/see-through filtration mask embodiment that does not visibly obstruct a person's mouth with a filtration system along the periphery or optionally near a person's chin or cheeks. Though embodiments of the transparent facemask may not eliminate the muffled speech of a person talking while wearing the transparent facemask, communication is improved by virtue of seeing the wearer's face while they are speaking.

Several different clear/transparent facemask embodiments are presented herein including a transparent anti-contagion facemask with and without a breather filter gasket along the periphery. The anti-contagion facemasks herein provide a common feature of being able to make visible a person's mouth through a facemask without obstruction, which facilitates seeing a person's mouth and lips while they are speaking. Some embodiments feature at least one filtered breather port in the facemask with an added air filtration gasket attached to the periphery of the facemask. The air filtration gasket can compress against the face when worn. These embodiments aim to improve the effectiveness of facemasks by providing a semipermeable filtration gasket along the periphery of the facemask to correct for the present day problems of insufficiently sealed facemasks against the person's face. A facemask that is insufficiently sealed will have gaps at the interface between the mask and a person's face through which unfiltered air will freely enter the space within the mask because air will flow along the path of least resistance. One object of the present invention is to improve facemask effectiveness by placing a filter gasket along the facemask periphery, which compresses against a person's face when worn properly. With the filter gasket compressed against the person's face, any air either entering the mask or escaping from the mask along the mask's periphery will be filtered through the filter gasket forming the facemask periphery. Optional embodiments contemplate that instead of a filter gasket, the facemask seal against a person's face is made by providing a low durometer flange that conforms to the person's face. Yet other embodiments contemplate the facemask featuring a conforming flange made from the same material as the rest of the facemask that presses against a person's face thereby essentially forming a seal against a person's face to force a pathway of air only through the filters in the facemask.

FIGS. 1A-1G are line drawings depicting various views of at least one facemask embodiment consistent with embodiments of the present invention. Certain elements of a human face 515 referred throughout the description are referenced in FIG. 1G. FIG. 1A is an isometric line drawing of a filtration gasket facemask embodiment 100 consistent with embodiments of the present invention. The filtration gasket facemasks 100 generally comprises a face covering cup 101 that is configured to cover both a human mouth 504 and human nostrils 502. In this embodiment, the face covering cup 101 is a unitary clear flexible molded PVC cup that extends over a person's nose 510, cheeks 514 and along their jawline 506. By unitary, it is meant that the clear flexible cup 101 is molded from a single piece of material. A molded nose portion 120 in the front of the face covering cup 101 generally conforms to the anatomy of a person's nose 510 terminating at the bulbous end of a person's nose 510. Just below the molded nose portion 120 is an indent 127 in the face covering cup 101 that is directly, or otherwise immediately, in front of where a person's nostrils 502 would be when the facemask 100 is worn. A breather port filter 110 (that covers at least one breather port aperture 135 of FIG. 1B) is disposed over a portion of the facemask 100 that covers a person's chin 508 thereby providing an unobstructed view of the person's mouth 504. In the present embodiment, the breather port filter 110 is anchored to the face covering cup 101 via a breather port filter frame 125. In this embodiment, a filter gasket 105 is disposed along the cup periphery 102 (shown in FIG. 1B). The facemask 100 is held on a person's face 515 thereby compressing the filter gasket 105 against the face 515 by way of an elastic strap 116 that is connected to a pair of head strap attachment anchors 115.

Figure 1B:
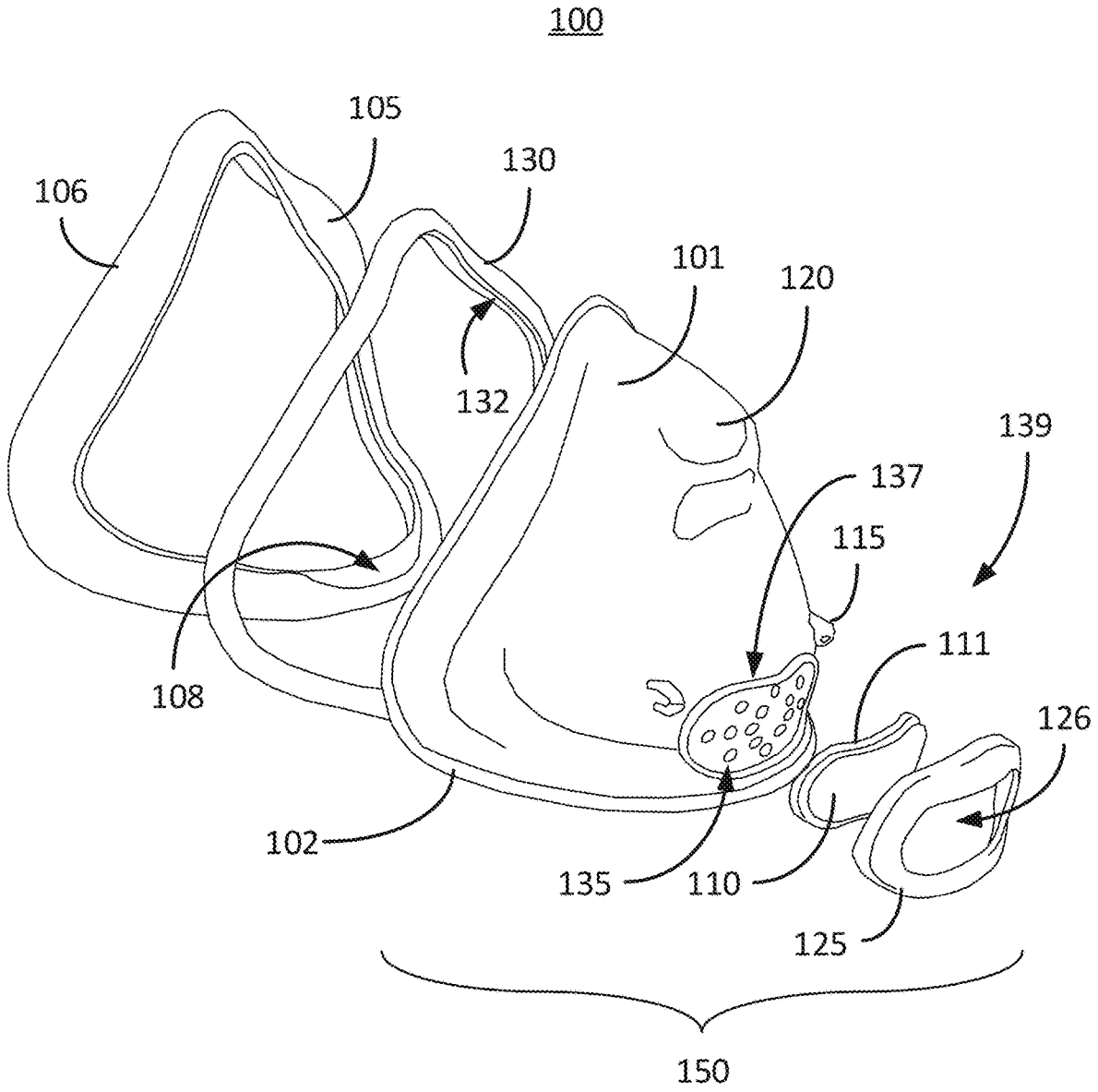

FIG. 1B is a line drawing of an exploded view of the facemask embodiment 100 of FIG. 1A consistent with embodiments of the present invention. In this embodiment, the transparent face covering cup 101 illustratively shows a plurality of breather port perforations 135 in the front of the face covering cup 101. The breather port perforations 135 are essentially in front of where a person's mouth 504 would be when worn so that when the person breaths, air will flow into and out of the facemask 100 just below the mouth 504 without obstructing viewability of the mouth 504 through the transparent face covering cup 101. In other words, as shown in the present embodiment, the breather port perforations 135 are in-line with (see centerline 422 of FIG. 1F) where a person's mouth 514 would be when worn but not obstructing visibility of the person's mouth 514 thereby taking advantage, or otherwise justifying, the transparency of the face covering cup 101. The plurality of breather port perforations 135 facilitates movement of air from an external environment into the internal environment 175 (see FIG. 2C) of the facemask 100 and vice versa when worn. Optional embodiments of the breather port 135 include one or more perforations that can be circular as shown or different shapes without departing from the scope and spirit of the present invention. A breather port filter frame 125 that fits over a filter lip 111 is located along the periphery of the breather filter 110 frames the breather port filter 110. The breather port filter frame 125 is attached to a breather port filter frame lip 137. The breather port perforations 135, breather filter 110, breather port filter frame 125, filter lip 111, are elements in the present embodiment that make up the filter system 139. However, a skilled artisan will appreciate that the present filter system 139 is simply a species of a greater genus, which can embody many different suitable filter system configurations (such as filter attachments, placements, materials whether single or laminates, shapes, etc.) within the scope and spirit of the present invention.

The face covering cup 101 defines a cup periphery 102 that is shaped to traverse the bridge of a person's nose 512 and along their cheeks 514 and jaw line 506, as shown. In other words, the cup periphery 102 essentially rests along the bridge of a person's nose 512, their cheeks 514, their jawline 506 and their chin 508. In the present embodiment, a gasket filter armature 130 is configured and arranged to cover the cup periphery 102. The gasket filter armature 130 provides structure to improve a contact seal of the filter-to-face contact periphery 106. Certain embodiments envision the gasket filter armature 130 being a pliable tubular structure, such as foam or latex, for example. The filter material can be either the same or different from the filter gasket 105. In the present embodiment, the gasket filter armature 130 comprises an armature channel 132 that receives the cup periphery 102. The gasket filter armature 130 can be glued, pressure fit, bonded in some other way or unitarily formed in place along the cup periphery 102, to name just a few examples of connecting the gasket filter armature 130 along the cup periphery 102. A filter gasket 105 covers the gasket filter armature 130 and a 'small portion' of the face covering cup 101 along the cup periphery 102 via a gasket filter channel 108. By 'small portion' it is meant that at least just enough of the face covering cup 101 is used/required to accomplish holding/supporting the gasket filter armature 130 in place via the armature channel 132. In the present embodiment, the filter gasket 105 covers the filter gasket armature 130. There are a number of ways the filter gasket 105 can be attached to the cup periphery 102, which can include adhesive or a mechanical latch configuration, as will be appreciated by a skilled artisan once intellectually in possession of the present invention.

The filter gasket 105 is made out of a porous material that in some embodiments is the same material as the breather port filter 110. The filter gasket 105 compresses against a person's cheeks 514, jawline 506 and across the bridge 512 of their nose 510 along the filter-to-face contact periphery 106 when the facemask 100 is strapped or otherwise retained over a person's nose 510 and mouth 504. Certain embodiments envision the filter gasket 105 thick enough, i.e., constructed in a suitable manner, to close any gaps between the person's face 515 and the filter-to-face contact periphery 106. Embodiments that include the filter gasket 105 and gasket filter armature 130 combination improve the seal around the filter-to-face contact periphery 106. The term "seal" as used in conjunction with embodiments of the present invention is envisioned to mean essentially full/intimate contact of the filter-to-face contact periphery 106 with a person's face 510 even though filtered air can pass in and out of the facemask interspace 175 through the filter gasket 105. Certain embodiments envision the filter gasket 105 made from an N-95 or N-99 filter material, or some other filter material that is efficient in filtering viruses and/or bacteria (germs) from passing there through. With the filter gasket 105 pressed tightly against a human face 515 along the filter-to-face contact periphery 106, there will be essentially no gaps between the facemask periphery 102/106 and the wearer's face 515. The present system possesses two basic paths of filtered air that can flow into and out from the facemask interior 175. The two basic paths are: 1) air flowing through the filter gasket 105, and 2) air flowing through one or more filters covering the at least one breather port 135 in the face covering cup 101.

Figure 1C:
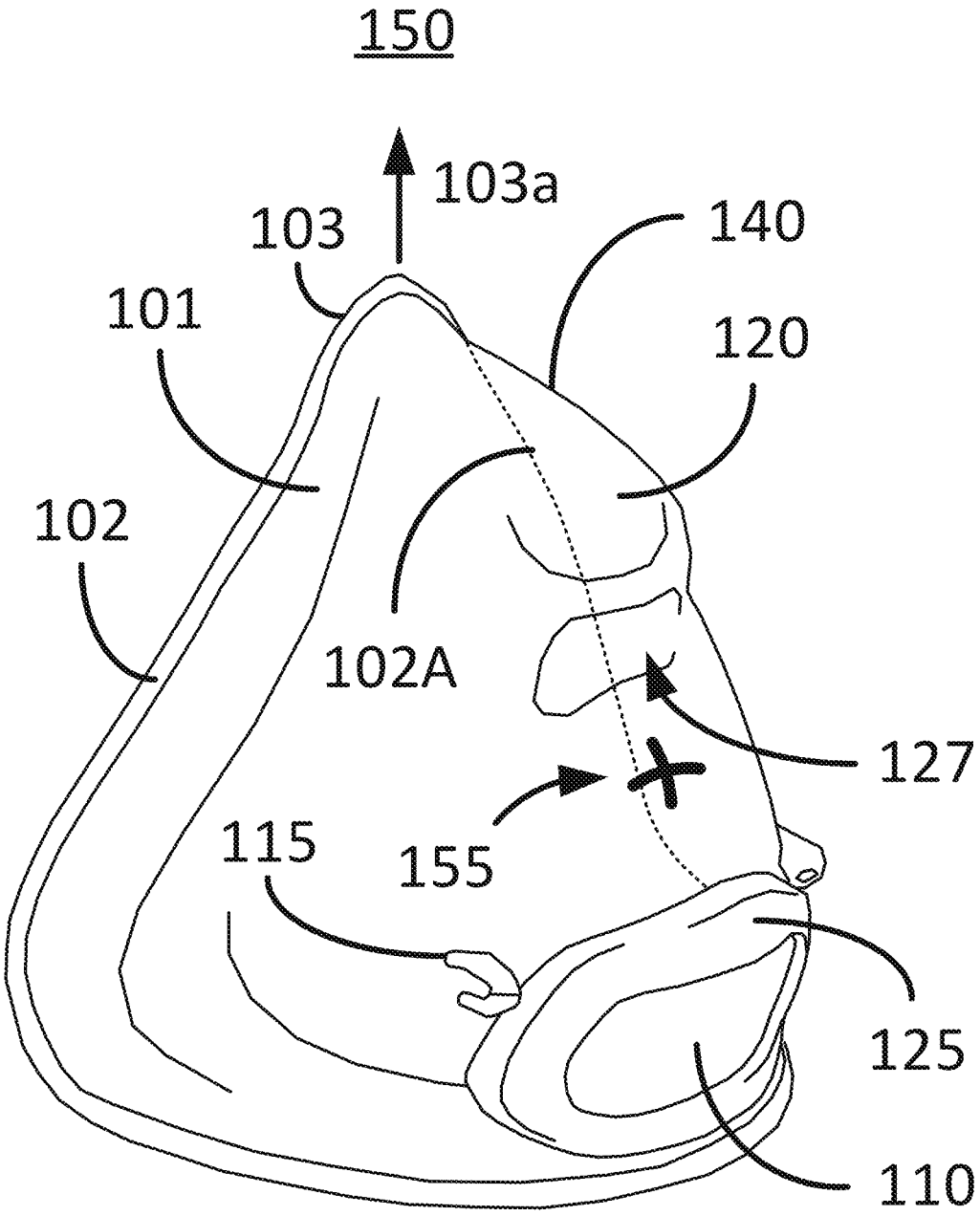
Figure 1D:
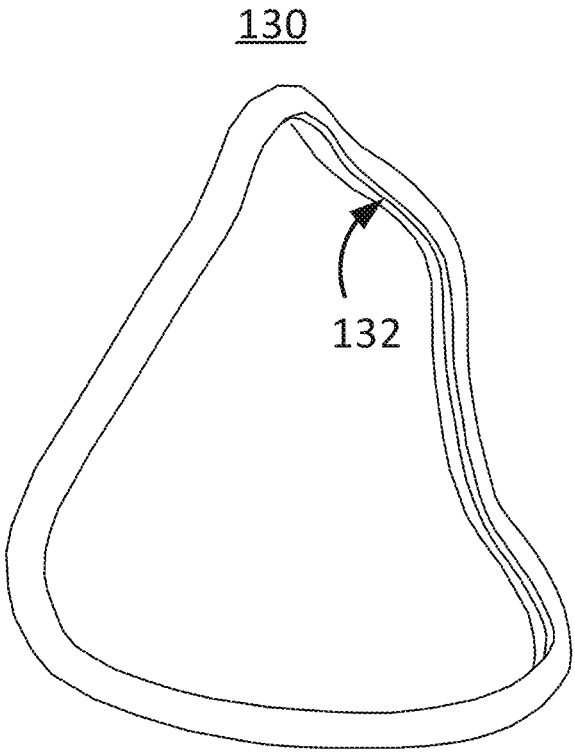
Figure 1E:
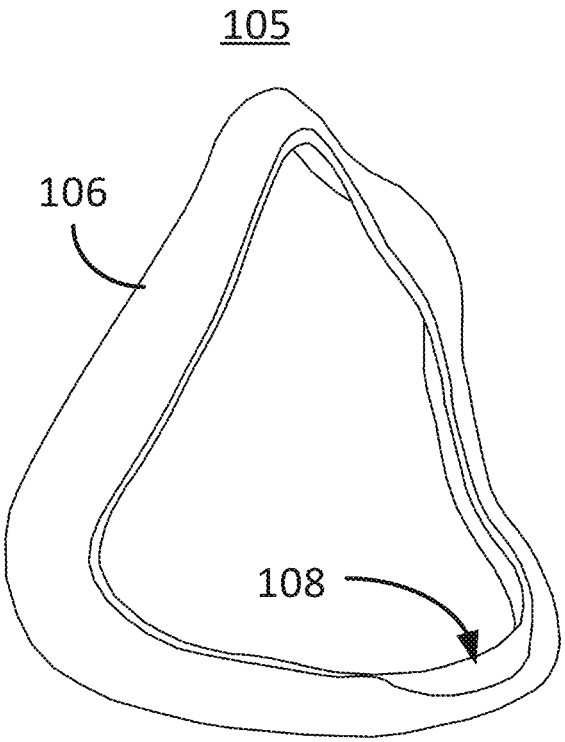

FIGS. 1C-1E are line drawings of the three main elements of the facemask 100 individually shown. FIG. 1C is a line drawing depicting the outer surface 140 of a passive transparent respirator assembly 150 that essentially includes the transparent facemask cup 101 and the front breather filter 110, but not the gasket filter armature 130 or the filter gasket 105. The passive transparent respirator assembly 150 comprises the front breather filter 110 attached to transparent facemask cup 101 via the breather port filter frame 125. The breather port filter frame 125 is one embodiment of a means for attaching the front breather filter 110 to the transparent facemask cup 101. Someone skilled in the mechanical arts will readily recognize adhesive and/or at least one mechanical latch are just two optional means for attaching the front breather filter 110 to the transparent facemask 101.

The term "passive", as used in the element passive transparent respirator assembly 150, is defined as the action of air passing from outside of the passive transparent respirator assembly 150 to the inside of the passive transparent respirator assembly 150 only under the power of a person breathing on their own and without the assistance of an external pumping device. Hence, the passive transparent respirator assembly 150 operates only via a human breathing in and out and without the assistance of an external pump.

The transparent facemask cup 101 comprises a cup periphery 102 (and 102A, which is the cup periphery as seen through the outer surface 140 of the transparent facemask cup 101) that when worn by a person 500 traverses the bridge 512 of the person's nose 510, along their cheeks 514, and around their jaw line 506. In the present embodiment, the cup periphery 102 comprises a lip 103, which in certain embodiments is a bead that extends outwardly from the cup exterior surface 140 as shown by the arrow 103*a*. Some embodiments contemplate the lip 103 extending outwardly from the cup exterior surface 140 along only a part of the cup periphery 102 while other embodiments envision the lip 103 extending along the entire cup periphery 102. As described earlier, the molded nose portion 120 in the front of the face covering cup 101 generally conforms to the anatomy of a person's nose 510 terminating at the bulbous end of a person's nose 510. Just below the molded nose portion 120 is an indent 127 in the face covering cup 101 that is directly, or otherwise immediately, in front of where a person's nostrils 502 would be when the facemask 100 is worn. As appreciated by the proportions of the transparent respirator assembly 150, the front breathing filter 110 is positioned directly in front of a person's chin 508 below where a person's mouth 504 would approximately reside (shown by the "X" 155) under the transparent respirator assembly 150 when worn. Based on the placement of the front breathing filter 110 and the clear/see-through transparent facemask cup 101, the wearer's mouth 504 is unobstructed from the view of an outsider when the facemask assembly 150 is worn. It should be appreciated that in the present embodiment the head strap attachment anchors 115 are placed on either side of the front breathing filter 110. However, there are a number of other suitable locations on the face covering cup 101 where the head strap anchors 115 can be disposed without departing from the scope and spirit of the present invention. Certain embodiments of the present invention contemplate the passive transparent respirator assembly 150 used with or without a filter gasket 105 (the gasket being integrated or otherwise) that may essentially seal the passive transparent respirator assembly 150 against the person's face 500.

FIGS. 1D and 1E are isometric line drawings for of certain elements used to transform the passive transparent respirator assembly 150 into a passive filtration gasket assist facemask 100. As described in FIG. 1B, the gasket filter armature 130 comprises an armature channel 132, as shown in FIG. 1D. In certain embodiments, the Armature channel 132 is configured to snap over or otherwise slide over a bead 103 along cup periphery 102 via armature channel slot 132 where it is essentially retained on the transparent facemask cup 101. One skilled in the mechanical arts will readily appreciate (with the benefit of understanding the disclosed facemask 100) that the gasket filter armature 130 can be attached to the facemask cup 101 without the use of a bead or lip 103, but rather by way of adhesive or some other attaching means. In certain embodiments, the armature channel 132 is envisioned to be a flexible rubber or silicone gasket that can be cylindrically shaped to provide an enlarged structure for the filter gasket 105 to snap on to the cup periphery 102. The filter gasket 105 of FIG. 1E fits around or otherwise essentially encases the gasket filter armature 130 by receiving the gasket filter armature 130 in the filter gasket slot 108. In this way, the filter gasket 105 is retained mechanically on the passive transparent respirator assembly 150. Optional embodiments do not envision using an intermediate a gasket filter armature 130 whatsoever, rather the filter gasket 105 can be attached to the transparent facemask cup 101 directly. As mentioned earlier, the filter gasket 105 can be made of filter material, such as that used in the breather port filter 110, felt, or some other air permeable material allowing passive breathing that conforms to a person's face 515. In this way, a filtering seal or an improved semi sealed region along the interface of the filter-to-face contact periphery 106 is provided.

Figure 1F:
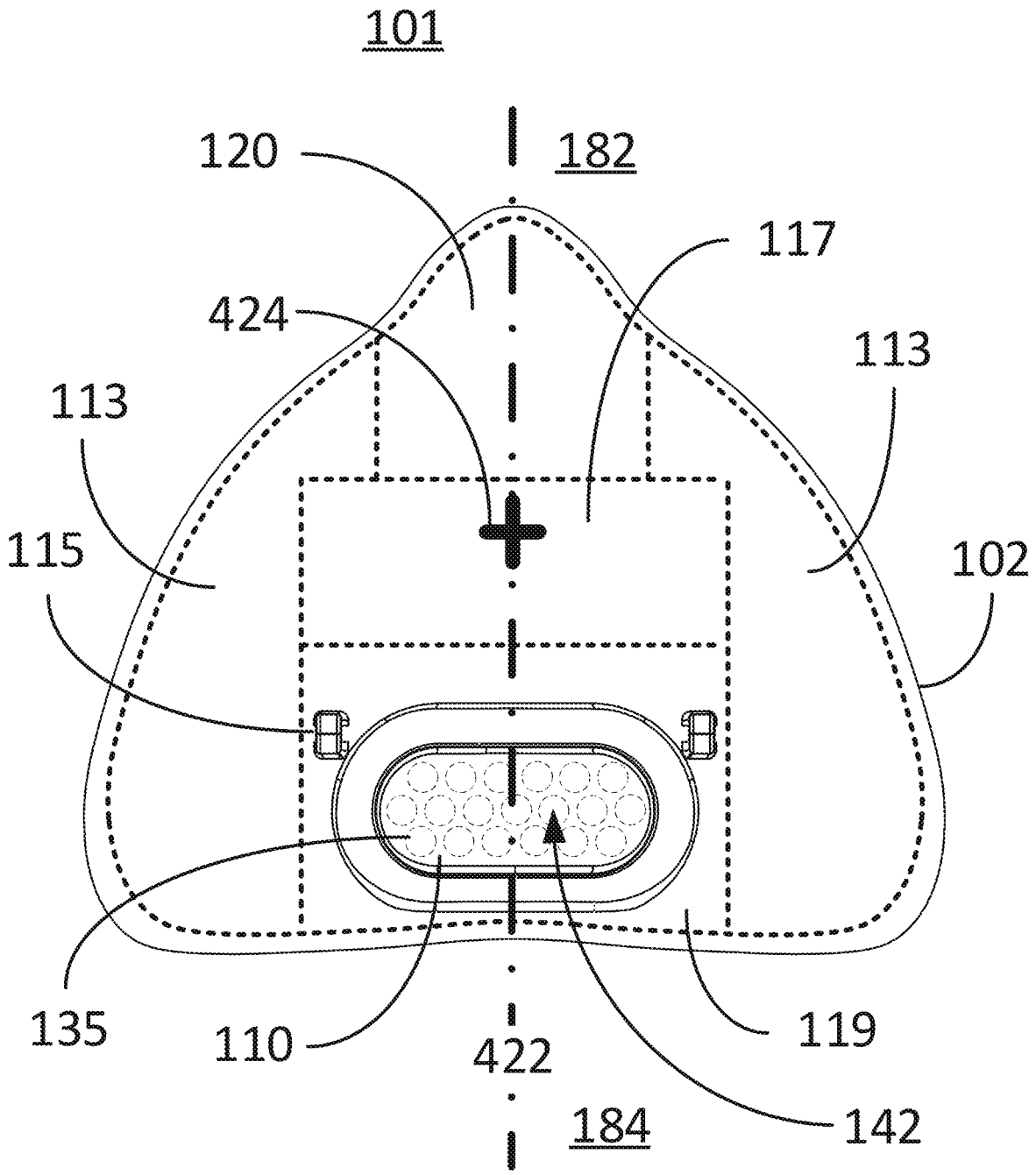

FIG. 1F is a front view of the passive transparent respirator assembly 150 consistent with embodiments of the present invention. This front view of the passive transparent respirator assembly 150 is broken into sections via dashed lines to show different face covering regions. For reference, the upper part 182 of the face coving cup 101 is labeled and the lower part 184 of the face covering cup 101 is labeled. Also, the term 'above' is in the direction of the upper part 182 and 'below' is in the direction of the lower part 184. Specifically, the nose covering region 120 is configured to cover human nostrils 502 and at least a portion of a human nose 510, such as at least a portion of the bridge 512 of a person's nose 510. Directly under the nose covering region 120, in the direction below 184, is a mouth covering region 117 essentially marked off by the rectangular dashed border as shown. The mouth covering region 117 is directly/immediately in front of a person's mouth 504 (i.e., at a right angle out of the page), which provides an unobstructed view of a person's mouth 504, through which an onlooker can see a person talk without their lips being obscured by a filter, for example. Below the mouth covering region 117, in the direction of the lower part 184, is a chin covering region 119, which is configured to cover at least a portion of a human chin 508. The chin covering region 119 is defined by the upper dotted line (which is shared with the lower mouth covering region line), two side dotted lines and the dotted line along the cup periphery 102, as shown. The cheek covering regions 113 are configured to cover a portion of a person's cheeks 514. This mask layout 113, 117, 119, 120 can essentially be equally be applied to the other embodiments described herein. A midline 422, which is an imaginary line, extends along the front of the face covering cup 101 bisecting the nose covering region 120, the mouth covering region 117 and the chin covering region 422, as shown. A cup center point 424 (a thick plus sign) is located along the midline 422 approximately between wearer's nostrils 502 and a wearer's mouth 504. The wearer's mouth is defined where person's upper lip and lower lip meet. Because the center point 424 is the equidistant local (approximately) between wearer's nostrils 502 and a wearer's mouth 504 the center point 424 is not necessarily in the middle of the face covering cup 101. As shown, the breather port filter 110 and breather port apertures 135 (which are dashed lines to show that they are behind the breather port filter 110) are part of the passive respirator intake (and outlet) pathway 142 located in the chin covering region 119, which can optionally extend into the cheek covering regions 113. Most importantly, in the present embodiment the breather port filter 110 and breather port apertures 135 are not in the mouth covering region 117 and therefore do not obstruct viewability of a wearer's mouth 504. It should be appreciated that the regions 113, 117, 119 and 120 are artistically placed to provide a sense of where these regions are located and should not be construed as precise or exact.

Figure 1G:
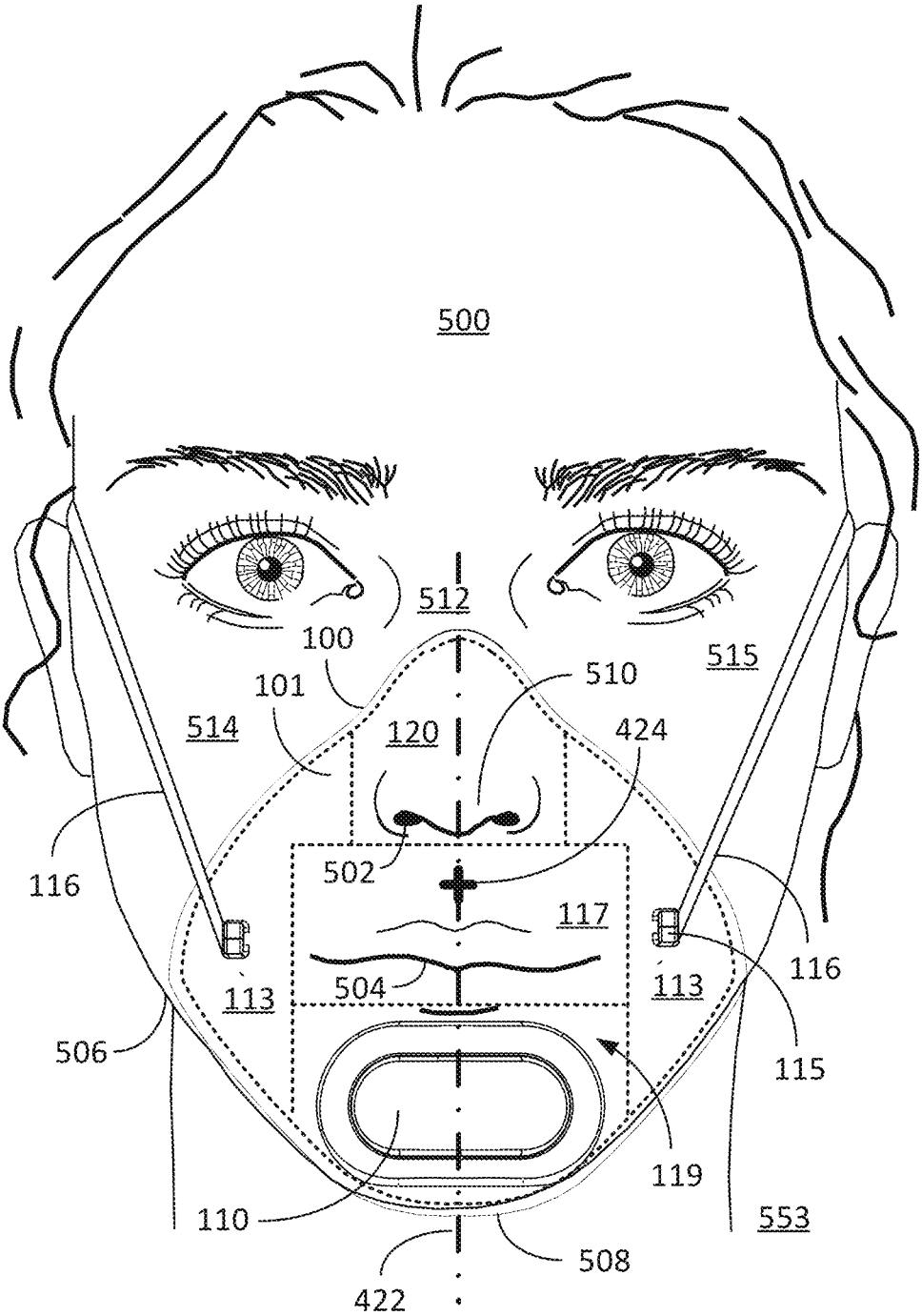

FIG. 1G illustratively depicts a person 500 wearing the passive filtration gasket facemask embodiment 100, however the passive transparent respirator assembly embodiment 150 can just as easily be worn similarly as shown without departing from the scope and spirit of the present invention. In the present embodiment, the face covering cup 101 is a transparent (i.e., essentially clear), pliable and essentially resilient. Accordingly, one embodiment envisions the face covering cup 101 being formed from a transparent polymer (or elastomer) cup. By resilient, it is meant that the face covering cup 101 will elastically return or otherwise elastically recover to its original shape after a deforming load is removed. Or more plainly, the face covering cup 101 when worn will deflect around the contours of the wearer's face 515, but will return to its original shape after it has been worn and is hung up or put on a table, for example. Hence, a fabric facemask, a rigid facemask or some other facemask that does not spring back to its original shape by itself when not under any kind of load are examples of facemasks that are not resilient within the scope of resilience as used herein. As shown the transparent face covering cup 101 can be made out of a clear PVC, or similar material, showing the person's face 515 underneath the facemask 100. As also shown, the cup periphery 102 extends over the bridge 512 of the wearer's nose 510, along each of their cheeks 514, and along their jawline 506. Accordingly, the nose region 120 covers the person's nostrils 502 and at least a portion of their nose 510. Directly under the nose covering region 120 (in the below direction 184) is the mouth covering region 117 that is directly/immediately in front of a person's mouth 504, thereby providing an unobstructed view of a person's mouth 504 through which an onlooker can see a person talk without their lips being obscured by a filter, for example.

Certain embodiments envision the mouth covering region 117 configured to completely cover a human mouth 504 without any external viewable obstruction to the human mouth 504 when the human mouth 504 is closed (that is with lips pressed together as shown in FIG. 1G). Without any external viewable obstruction means that an onlooker that is externally facing the person 500 who is wearing the transparent face covering cup 101 views the wearer's mouth 504 without their view being obstructed by a filter or any other component in the mouth covering region 117, so that the onlooker can clearly see the wearers lips. Certain other embodiments envision the mouth covering region 117 being large enough to see the wearer's lips moving (such as less than 1 inch opening between upper and lower lips) without any external viewable obstruction.

A chin covering region 119 below the mouth covering region 117 (in the below direction 184) is configured and located to essentially cover at least a portion of the wearer's chin 508. The cheek covering regions 113 are shown covering a portion of a person's cheeks 514. As is further shown, the midline 422 extends along the front of the face covering cup 101 bisecting the nose covering region 120 the mouth covering region 117 and the chin covering region 422. The cup center point 424 is located along the midline 422 approximately between wearer's nostrils 502 and a wearer's mouth 504. The breather port filter 110 and breather port apertures 135 are in the chin covering region 119 directly in front of the person's chin 508. Hence, the wearer's mouth 504 is unobstructed by the breather port filter 110, which, in certain embodiments, can further extend into the cheek region 113, such as along the jawline 506.

Figure 1H:
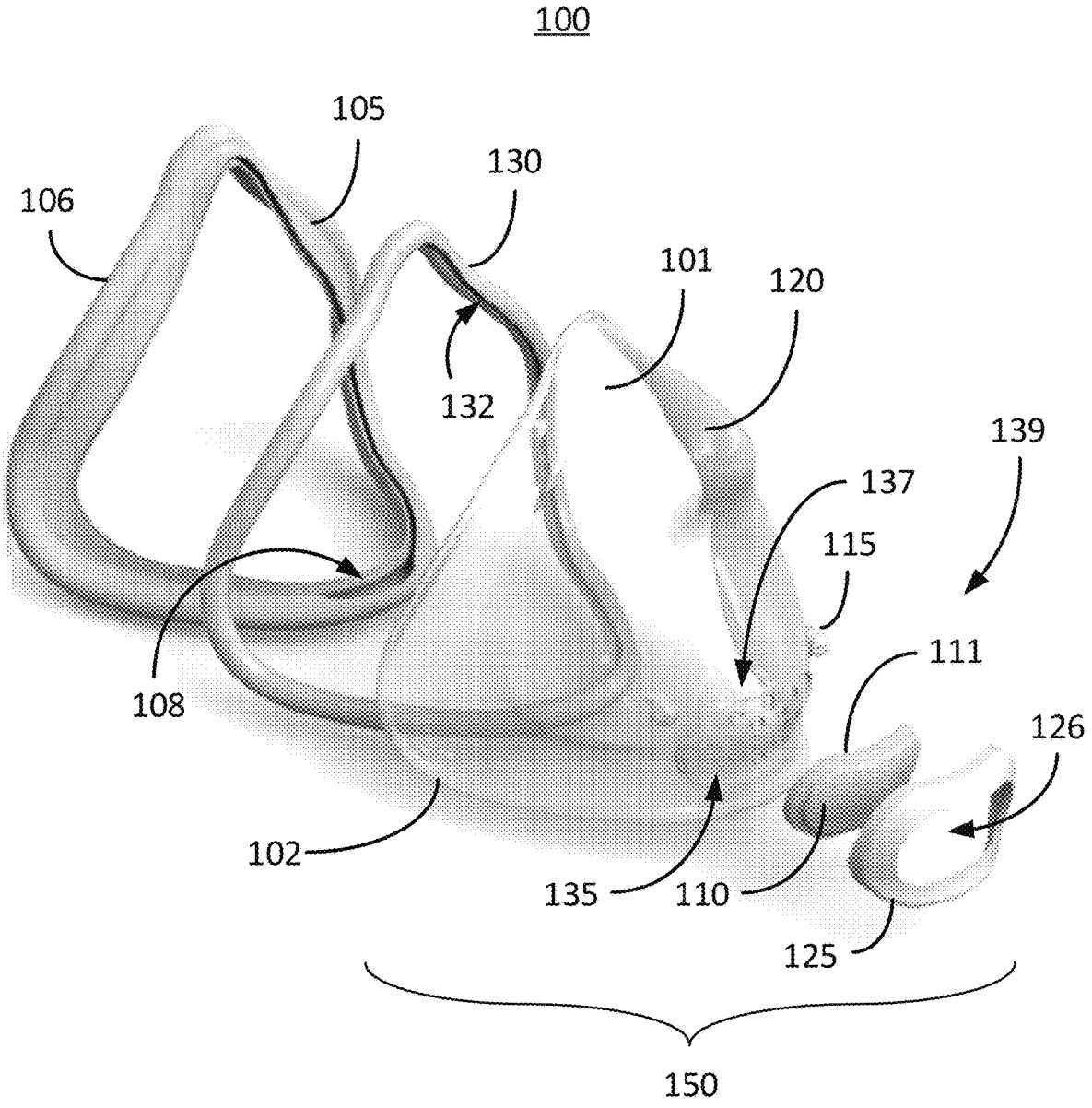
FIG. 1H is a color illustration of the exploded line drawing of FIG. 1B to illustratively show the transparent face covering cup 101.

FIG. 1H is a color illustration of the exploded line drawing of FIG. 1B to illustratively show the transparent face covering cup 101 and other facemask elements. The elements of FIG. 1H are identical to FIG. 1B.

Figure 2A:
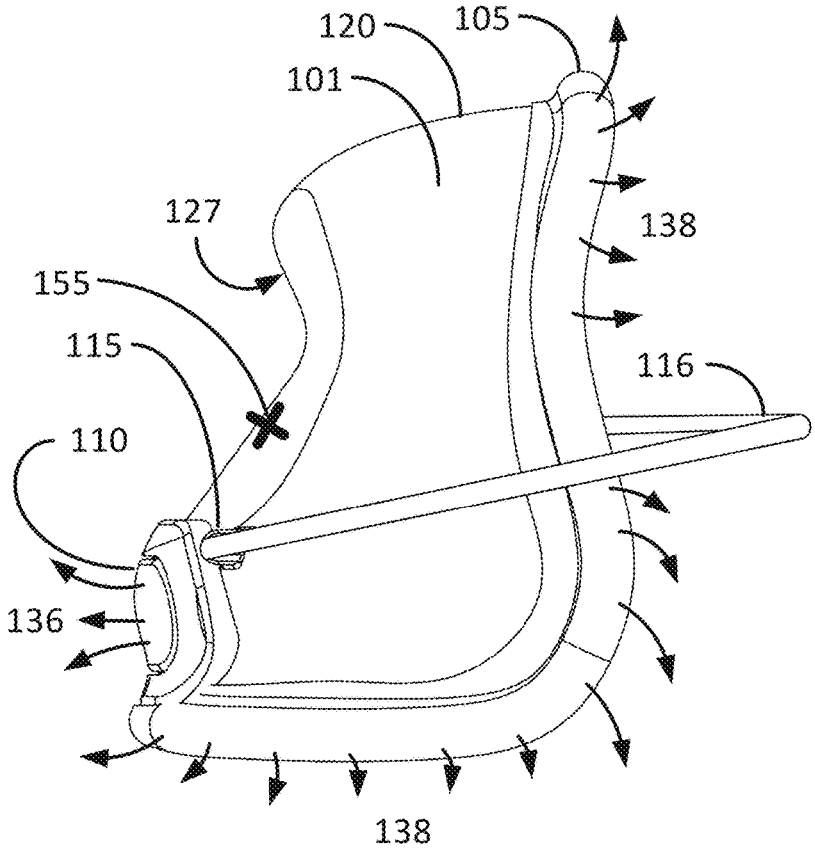
FIGS. 2A-2C are line drawings of the facemask embodiment illustratively showing flow of filtered air moving out from the facemask 100 consistent with embodiments of the present invention.
Figure 2B:
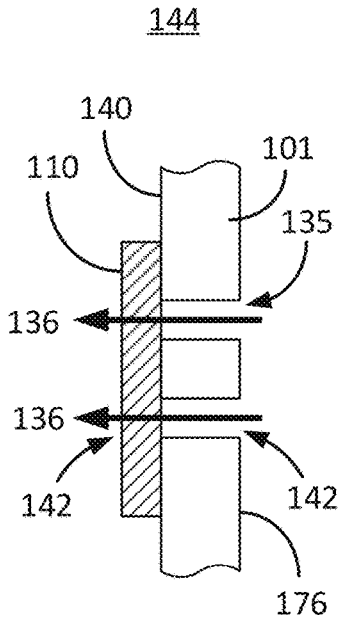
Figure 2C:
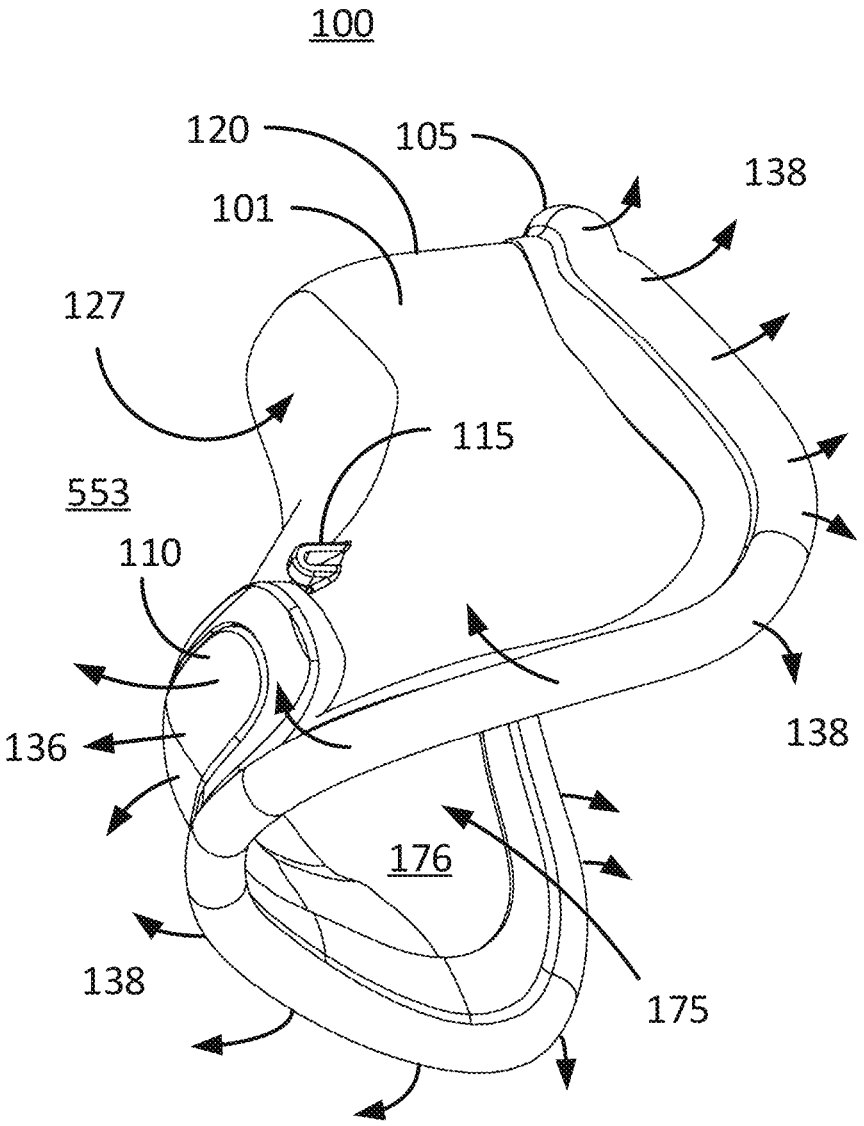

FIGS. 2A-2C are line drawings of the facemask embodiment 100 illustratively showing flow of filtered air moving out from the facemask 100 consistent with embodiments of the present invention. FIG. 2A is a side view line drawing of the facemask 100 comprising an elastic strap 116 configured to loop around the back of a person's head when wearing the facemask 100. As shown, a filter gasket 105 is attached the entire cup periphery 102 (hidden from view in FIG. 2A) and though a person's face is not drawn in this figure, the filter gasket 105 should be imagined intimately contacting a human face 115 along a filter-to-face contact periphery 105. With the facemask 100 being worn, the curved arrows 136 and 138 illustratively show the direction of filtered air exhaled from the person through the breather port filter 110 and through the filter gasket 105. The facemask 100 in this view is tipped clockwise about 45° from how the actual facemask 100 is worn on a person's face 515 presented in a neutral position as shown in FIG. 1G. The "X" 155 is approximately where a person's mouth 504 would reside immediately behind the transparent respirator assembly 150 when worn. Likewise, the indent 127 just below the molded nose portion 120 is essentially directly in front of where a person's nostrils 502 would be when the facemask 100 is worn.

FIG. 2B is a cross-section line drawing of the passive respirator intake/outlet region 144 (a portion of the filter system 139 as seen in FIG. 1H) consistent with embodiments of the present invention. As shown, the passive respirator intake/outlet region 144 includes a portion of the face covering cup 101 (such as in the chin region 119), filter material 110 and the breather port apertures 135. In this embodiment, the passive respirator intake (and outlet) pathway 142 includes the filter material 110 and the breather port apertures 135 and shows the flow of outlet air 136 through the passive respirator intake (and outlet) pathway 142. The breather port apertures 135 penetrate through the face covering cup 101 between and including the outer (outside) cup surface 140 and the inner (inside) cup surface 176.

FIG. 2C is a perspective drawing looking underneath the jawline portion of the facemask 100 showing the inner surface 176 and interior environment 175 of the facemask 100 consistent with embodiments of the present invention. As shown by the curved gasket exhale arrows 138, filtered breath of a person's exhaled air (exhale) 138 passes through the filter gasket 105. Along these lines, breather port exhaled air arrows 136, which is the filtered breath of a person's exhale, is shown passing through the breather port filter 110 in the passive respirator intake (and outlet) pathway 142. Hence, exhaled air 136 from an infected person 500 is filtered if the person 500 has a virus and/or bacteria that would otherwise be breathed into the open environment 553 endangering those around them. Likewise, potentially contaminated air from infected people in proximity to the person 500 wearing the facemask 100 is filtered thereby providing protection to the person 500 wearing the gasket facemask 100.

Figure 3:
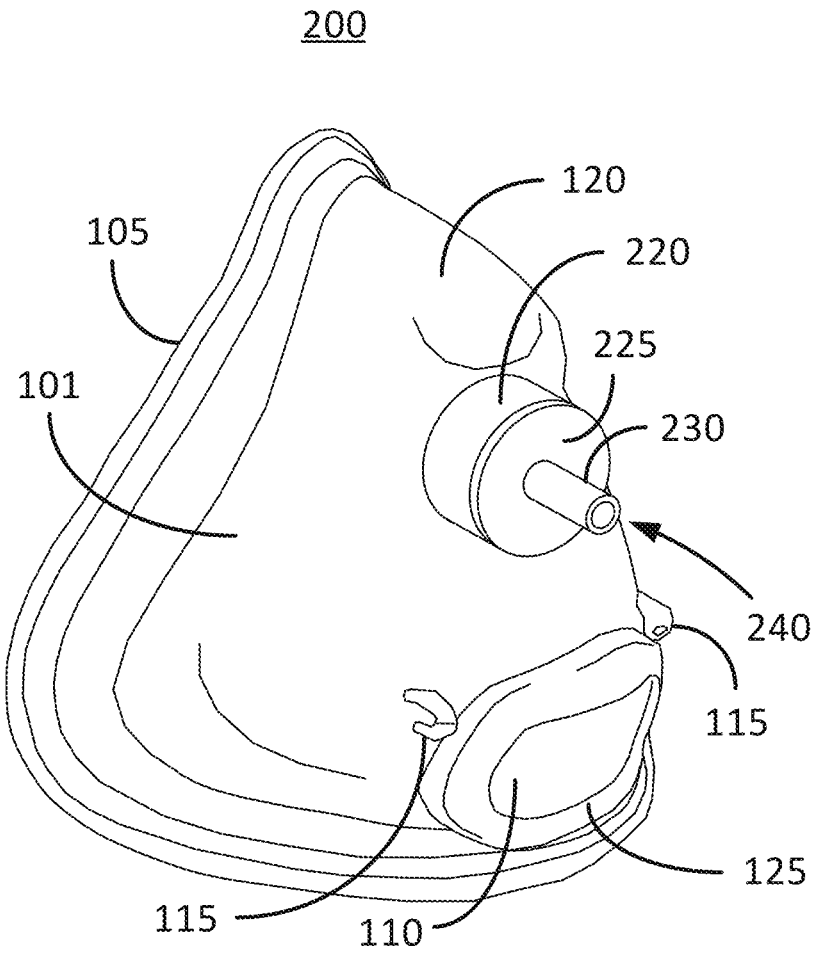
FIG. 3 is an illustration of an active gasket facemask embodiment (as opposed to a passive gasket facemask embodiment) with an oxygen intake port consistent with embodiments of the present invention.

FIG. 3 is an illustration of an active gasket facemask embodiment (as opposed to a passive gasket facemask embodiment) with an oxygen intake port consistent with embodiments of the present invention. The intake port gasket facemask 200 is similar to that of the gasket facemask embodiment 100 with the exception that the face covering cup 101 comprises an intake port 220 that, in certain embodiments, is envisioned to receive pressurized oxygen into the facemask 200 thereby making it an active facemask 200. In the present embodiment, a pressurized oxygen source, oxygen line (not shown), can be connected to the oxygen connector tube 230 that extends from an intake port face 225. The oxygen connector 230 is a hollow tube with an inlet port 240 that leads into the facemask 200. In the present embodiment, the intake port 220 is positioned over a person's nostrils 502 when they wear the facemask 200. In this way, the person mouth 504 is still viewable while wearing the active facemask 200 to enhance their ability to communicate with caretakers. The intake port gasket facemask 200 is envisioned to be used in a hospital setting where a patient, who needs oxygen from a facemask can be protected from germs in the outside environment and/or protects healthcare workers and the outside environment 553 from germs that would otherwise be exhaled into the outside environment 553 from the patient 500.

Figure 4A:
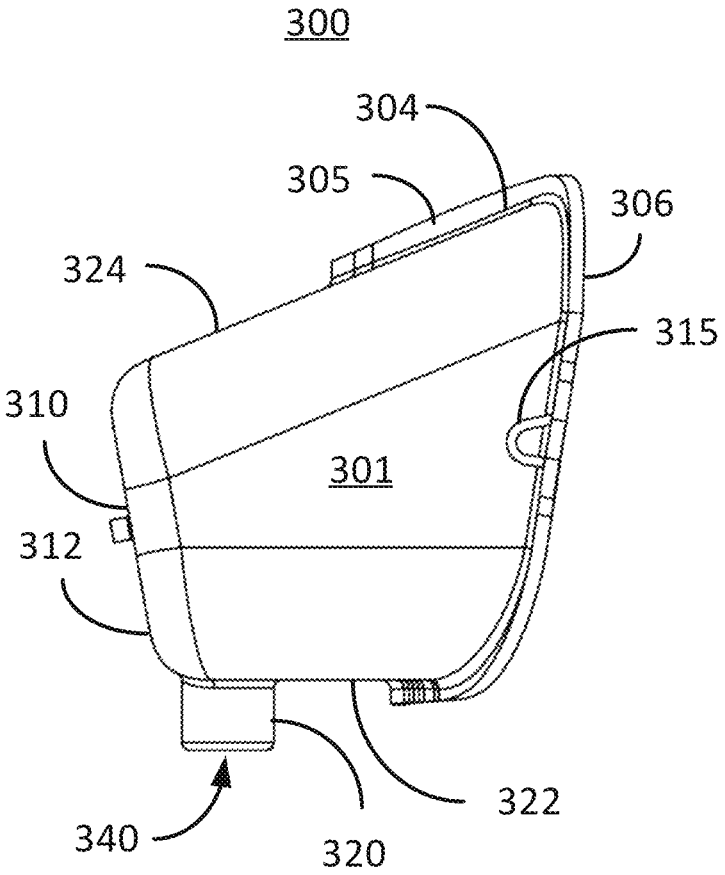
FIGS. 4A and 4B are line drawings of a micro gasket facemask configuration consistent with embodiments of the present invention.
Figure 4B:
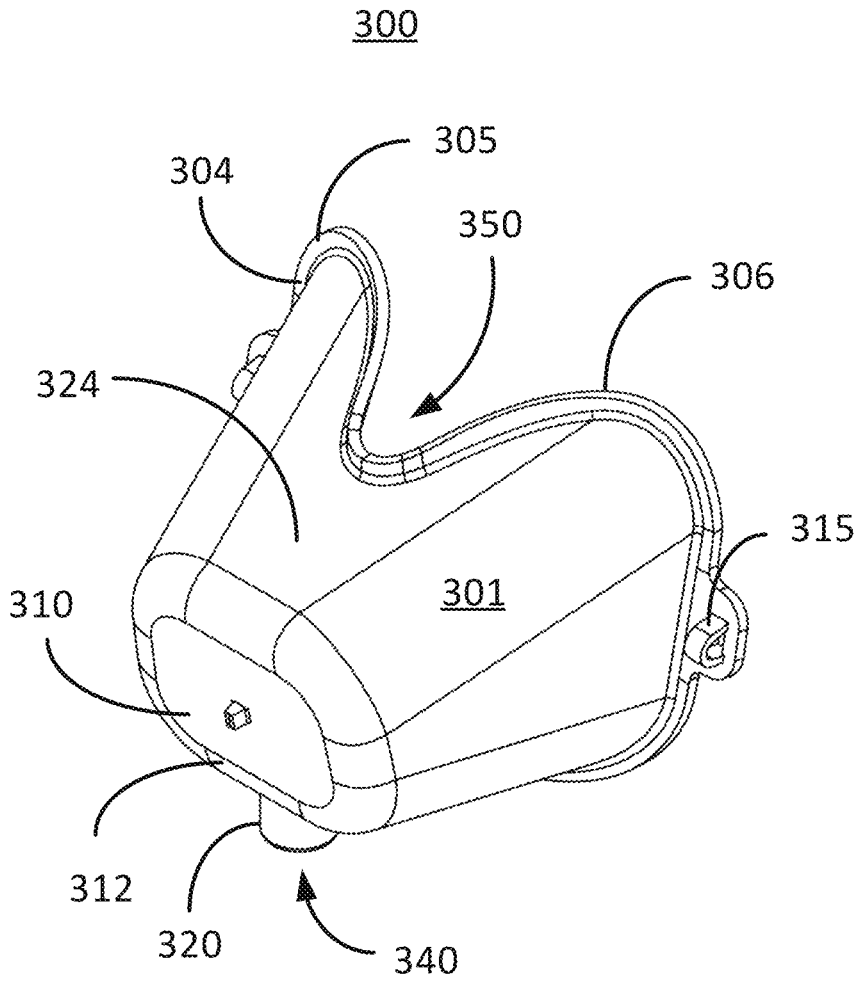

FIGS. 4A and 4B are line drawings of an active (non-passive) micro gasket facemask configuration consistent with embodiments of the present invention. FIG. 4A is a side view of a micro gasket facemask embodiment 300 and FIG. 4B is a top three-quarter view of the micro gasket facemask embodiment 300. The micro cup 301 of the micro gasket facemask 300 is reduced in size to fit specifically over a person's nostrils 502 and mouth 504 without traversing the bridge 512 of a person's nose 510, as shown by the nose notch 350. In other words, the micro cup 300 is more compact than the face covering cup 101. The micro gasket facemask 300 comprises a breather port filter 310 in the facemask front 312 and a filter gasket 305 that covers the mask periphery 304. In the present embodiment, an oxygen intake port 320 configured to receive enriched oxygen from an external source through an oxygen intake aperture 340 is located in the facemask bottom 322. The filter gasket 305 is configured to press against a person's face 514 to filter any air going in and out of the interior space of the micro gasket facemask 300, similar to the facemask embodiment 200. The filter gasket 305 can be a thick but permeable filter membrane, which can either be the same material as the breather port filter 310 or a different material. Similar to some of the previous embodiments, the filter gasket 305 and the breather port filter 310 can be N-95 filters, ULPA filters, HEPA filters, etc. Some embodiments envision the filter gasket 305 and the breather port 310 effective for filtering out viruses and/or bacteria. The filter and gasket embodiments described in conjunction with FIGS. 4A and 4B can equally be used in conjunction with the other embodiments described herein. In an embodiment where the micro gasket facemask 300 is transparent, the person's mouth 504 is viewable to read the persons lips 505 while the person 500 speaks.

Figure 5:
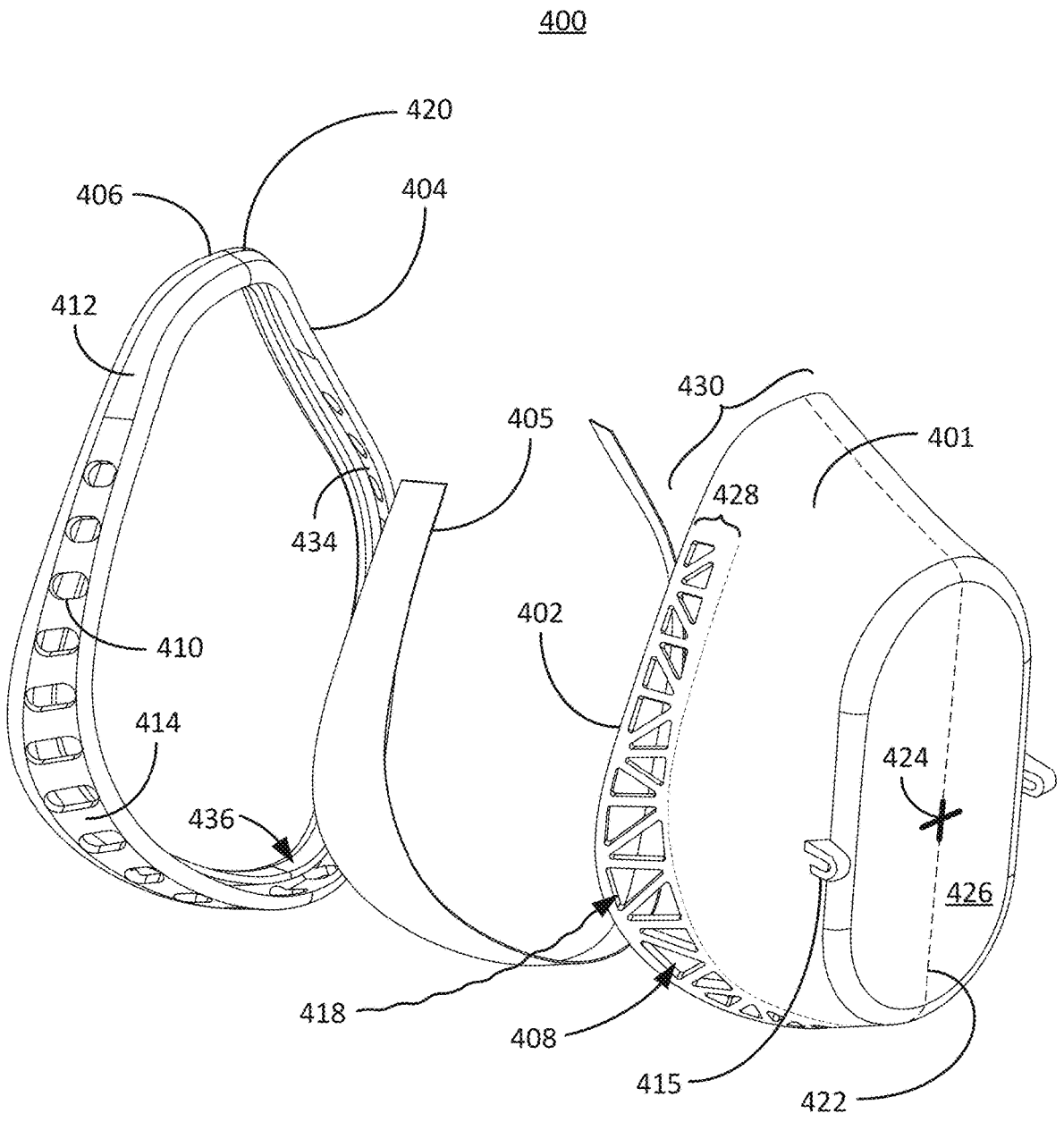
FIG. 5 is an exploded view line drawing of an optional passive transparent facemask embodiment consistent with embodiments of the present invention.

FIG. 5 is an exploded view line drawing of an optional passive transparent facemask embodiment consistent with embodiments of the present invention. FIG. 5 is described in conjunction with a person 500 wearing the facemask depicted in FIG. 7. The facemask embodiment 400 is a clear plastic/see-through facemask, e.g., clear PVC, which provides an unobstructed view of a person's nose 510 and mouth 504 behind (in the interior space 441 of) the facemask 400. When talking, a person 500 wearing the clear gasket facemask 400 is better understood because their lips 505 can be seen while they are speaking when wearing the clear facemask 400. The present gasket facemask embodiment 400 is yet another example of a passive facemask. Unlike other present day facemasks, the typical one or more filters, which are commonly disposed at or near the front of a facemask is avoided by placing the filter 405 along the periphery 428, as shown. Accordingly, some embodiments envision no filters (or breathing perforations, such as perforations 408 in the face covering cup 401) within 1.25 inches of the mask midpoint 424 that may obstruct viewing the wearer's mouth 504. The mask midpoint 424 is defined as a point that is equidistant between a person's nostrils 502 and mouth 504 when a person 500 is wearing the facemask 400. In the embodiment where there are no breathing perforations 408 within 1.25 inches of the mask midpoint 424, the perforations 408 do not necessarily have to reside along the periphery 428 as shown. Other embodiments envision the perforations 408 not within 1.5 inches of the mask midpoint 424, while yet other embodiments envision no perforations 408 within 1 inch of the mask midpoint 424. Still yet other embodiments envision no perforations 408 within 0.75 inches of the facemask midpoint 424.

The gasket facemask embodiment 400 is essentially a periphery air filtered facemask that generally comprises a clear (transparent) face covering cup 401 that is sized and configured to cover both a human mouth 504 and nostrils 502. The face covering cup 401 is defined by a cup that extends to a cup periphery 402. The cup periphery 402 is intended to traverse the bridge 512 of a person's nose 510 along their cheeks 514 and at or above their jawline 506, similar to the other facemask embodiments 100, 200, 300 and 700. The face covering cup 401 is further defined by a reference midline 422 that bisects the face covering cup 401 along the nose 510 from the bridge 512, between the nostrils 502 and across the mouth 500. The face covering cup 401 further comprises a plurality of breathing perforations 408, which are not limited to the triangular-shaped perforations depicted in the present embodiment. As shown in the present embodiment, the breathing perforations 408 are dispersed along the cup periphery 402 within a cup periphery region 428. In some embodiments, the breathing perforations 408 are dispersed less than 0.75 inches from the cup periphery 402. In other words, the cup periphery region 428 is less than 0.75 inches wide as defined from the cup periphery 402. In other embodiments, the breathing perforations 408 are essentially the only perforations that pass through the face covering cup 401. The breathing perforations 408 extend along the cup periphery 402 (in a U-shape from about 2:00-10:00 as seen on a clock face) except for a bridge periphery region 430, as shown. Other embodiments imagine the perforations extending over the bridge portion 430, however this might be blocked off by a person's nose bridge 512. In this arrangement the breathing perforations 408 are no less than 1.5 inches from the midpoint 424, but in other arrangements are no less than 1.00 inches from the midpoint 424.

A filter band 405 is configured to cover the breathing perforations 408 whereby air 418 (shown by the squiggly line) can be exchanged through the breathing perforations 408 in the filter cover band 414 only by way of the breather filter band 405. In this way, only filtered air can pass through the breathing perforations 408 from the outside 553. The breathing filter band 405 is envisioned to be any filter material comprising a pore size that meets a desired specification. For example, a pore size of less than 0.3 μm will filter out 0.3 μm particles, such as viruses. A pore size distribution where 95% of the pores are less than 0.3 μm is an N-95 filter material. Certain embodiments envision a filter band 405 that is reusable. In this embodiment, the reusable filter band 405 is able to be revitalized or otherwise essentially renewed to function at or near capacity. Examples of revitalization can be accomplished by way of washing, exposure to chemicals, ultraviolet light, heat, suction, or some other means of revitalizing or cleaning the filter band 405 that would be known to those skilled in the art. The filter band 405 can be attached to the face covering cup 401 by way of an adhesive or some mechanical latching mechanism, such as a filter cover 420. A skilled artisan will appreciate that the filter can be for viruses, bacteria, or other contamination in healthcare and/or outside healthcare, such as woodworking, for example.

The present embodiment illustratively depicts a filter cover 420 configured and arranged to mechanically retain or otherwise fix the filter band 405 to the face covering cup 401. By mechanically attaching to the face covering cup 401, certain embodiments contemplate that the filter cover 420 snaps into receiving features (not shown) in the face covering cup 401 or optionally slides around or otherwise fixes onto (snaps over) the cup periphery 402, just to name several of many species variations. The filter cover 420 generally comprises a plurality of filter cover perforations 410 that provide a pathway to the breathing perforations 408 via the filter band 405. The filter cover perforations 410, located between a face contact rim 406 and the mask periphery 404 in the filter cover band 414, are configured to align with the breathing perforations 408 in the face covering cup 401 so that the inside facemask environment is in communication with the outside environment via the filter 405. The face contact rim 406 is configured to contact a human face 515 over the bridge 512 of a person's nose 510, along their cheeks 514, and at or above their jawline 506. Certain embodiments envision the face contact rim 406 essentially sealing against a person's face 515 to restrict or otherwise inhibit the passage of air 418 to pass essentially only through the breathing perforations 408. In this way, filtered air moves into the facemask 400 via (essentially only through) the breathing perforations 408. Some embodiments envision the facemask rim 406 being silicone, a textile material, filter material, a flexible flange, or some other material and configuration that conforms to a person's face 515. In the event the facemask rim 406 is filter material, filtered air is envisioned to move through the facemask rim 406 into the facemask 400. The filter cover 420 can further possess a filter cover gap 436 between an interior filter cover surface 434 and the filter band 405. In some embodiments, the filter cover gap 436 is imagined to be less than 0.25 inches deep between the interior filter cover surface 434 and the filter band 405. Other embodiments envision a filter cover nose bridge portion 412 being bendable over the bridge 512 of a person's nose 510, such as by way of a compliant metal material to improve the fit and seal.

Figure 6A:
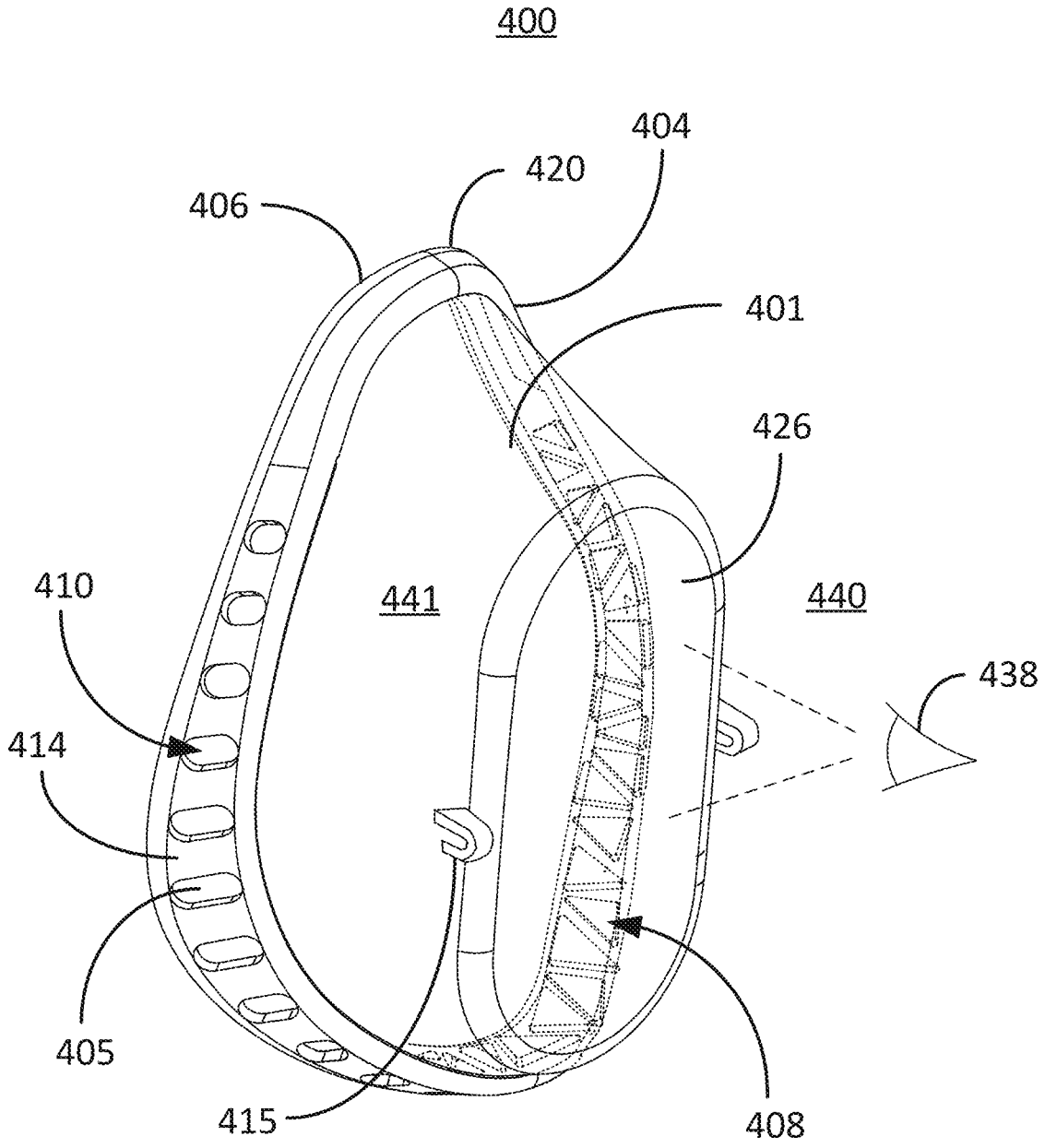
FIGS. 6A-6D depict different line drawing views of the gasket facemask consistent with embodiments of the present invention.

FIGS. 6A-6D depict different line drawing views of the gasket facemask 400 consistent with embodiments of the present invention. FIG. 6A shows an isometric view of the gasket facemask 400 illustratively showing head strap attachment anchors 415 located on either side of the midline 422 (of FIG. 5) wherein each head strap attachment anchor 415 is located between the cup periphery 402 (of FIG. 5) and the midline 422. The pair of head strap attachment anchors 415 are configured and arranged to be attached to at least one head strap 116 (in an attached/anchored relationship), which are not necessarily required to be placed as shown. In this embodiment, the face covering cup 400 is transparent thereby providing an unobstructed view of a wearer's mouth 504 and nose 510 as seen by an onlooker 438 from outside 440 of the facemask 400. In other words, an onlooker 438 can see, without obstruction, into the inside space 441 of the facemask 400 when viewed from the facemask front 426.

Figure 6B:
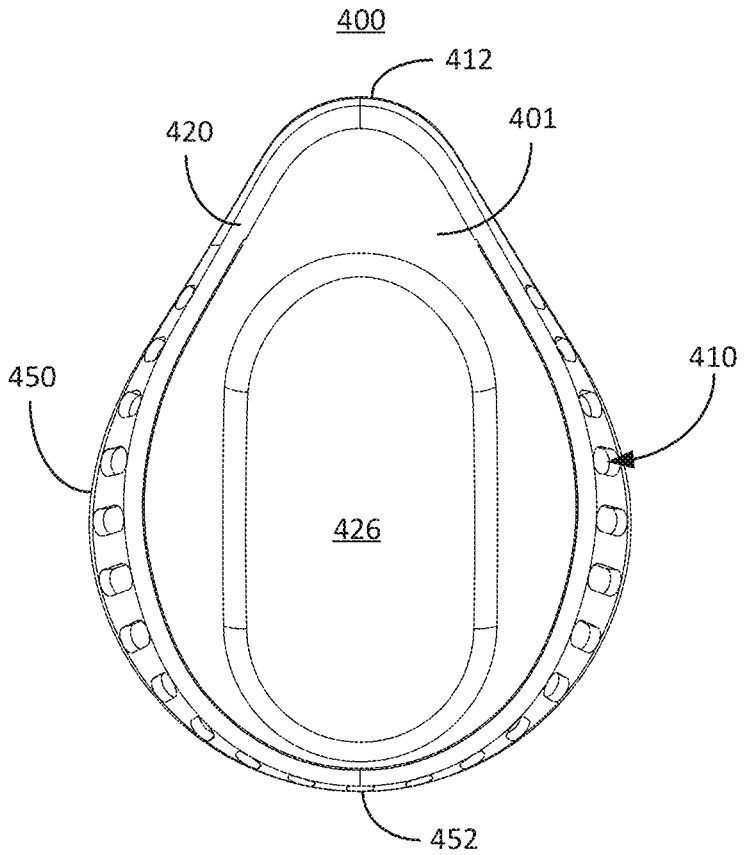

FIG. 6B shows a front view line drawing of the gasket facemask 400 consistent with embodiments of the present invention. In this embodiment, the facemask 400 has flared facemask sides 450 that cover a person's cheek 514 and a facemask chin portion 452 residing near or at a person's chin 508 (see description associated with FIG. 1F). Certain called-out elements of the front view line drawing are shown for reference with respect to FIG. 6A.

Figure 6C:
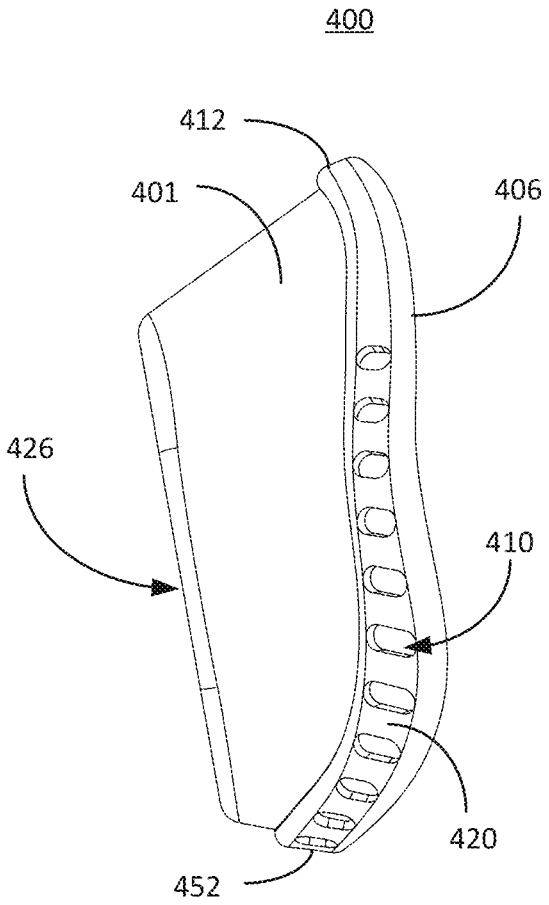

FIG. 6C shows a side view line drawing of the gasket facemask 400 depicting the face contact rim 406 of the filter cover 420 being a thicker material, which can include a compressible foam gasket, compressible/pliable silicone, filter material, just to name a few examples within the scope and spirit of the present invention. Certain called-out elements of the side view line drawing are shown for reference with respect to FIG. 6A.

Figure 6D:
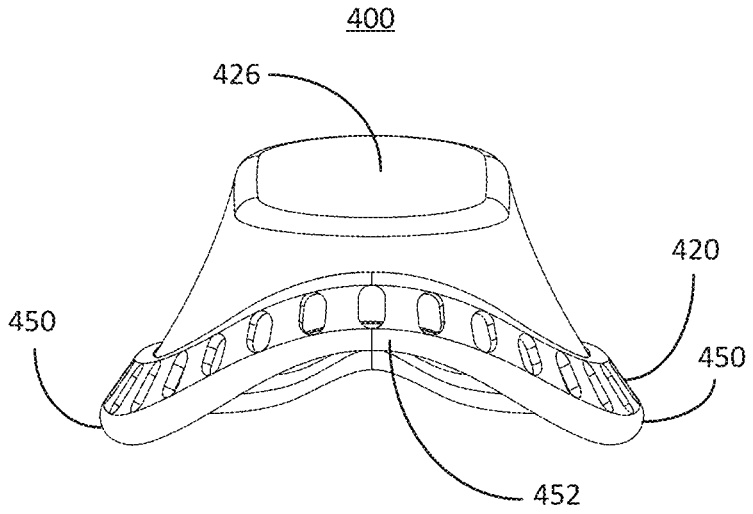

FIG. 6D shows a bottom view line drawing of the gasket facemask 400 showing the chin portion and the flared facemask sides 450 shaped to conform to a person's face 515. Certain called-out elements of the bottom view line drawing are shown for reference with respect to FIG. 6A.

Figure 7:
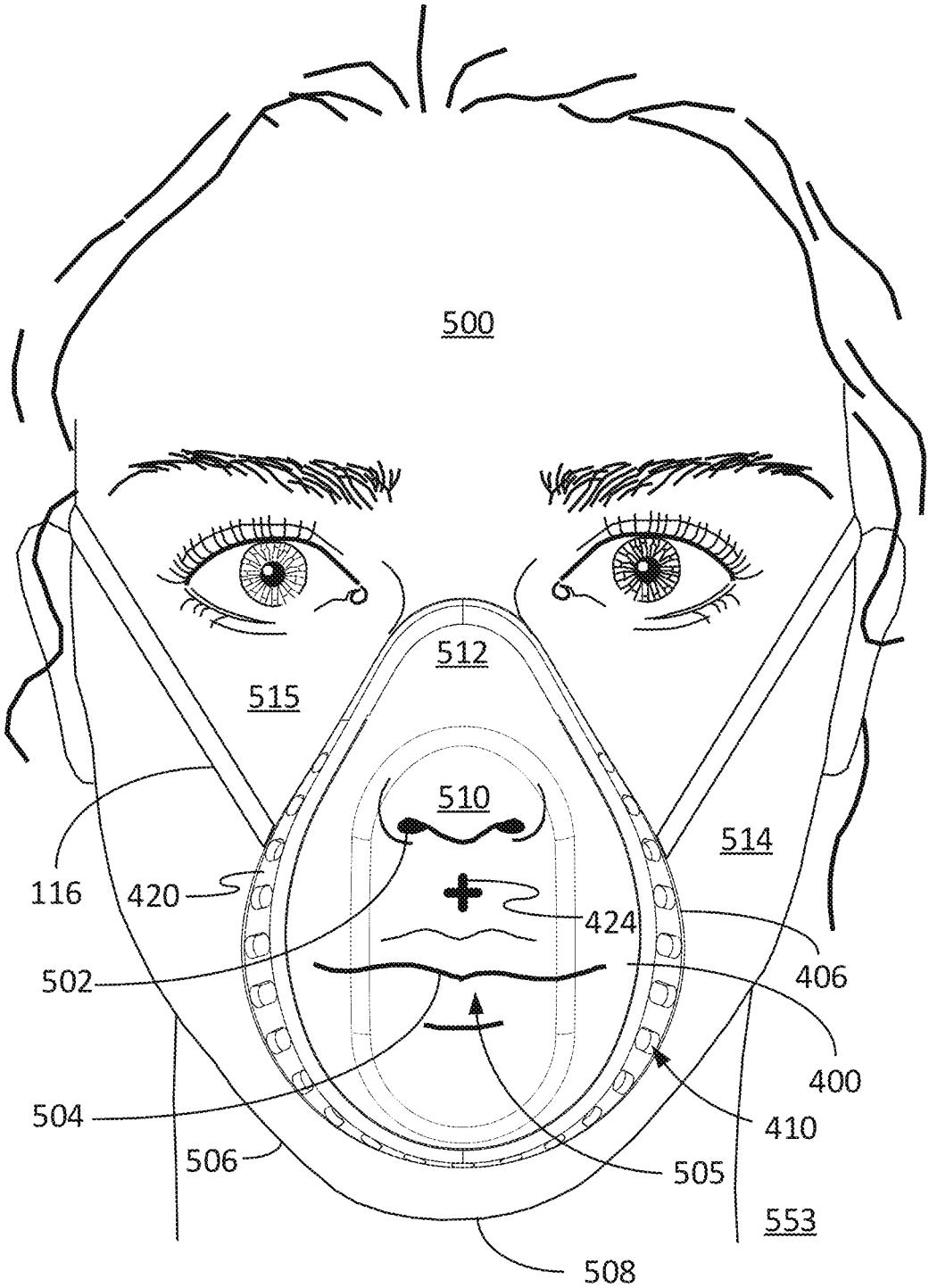
FIG. 7 illustratively depicts a line drawing of a front view transparent facemask embodiment being worn on a person consistent with embodiments of the present invention.

FIG. 7 illustratively depicts a line drawing of a front view transparent facemask embodiment 400 being worn on a person 500 consistent with embodiments of the present invention. The passive transparent facemask 400 covers a person's nostrils 502 and a person's mouth 504 whereby a reference mask midpoint 424 is defined as residing in an equidistant point between the person's nostrils 502 and mouth 504 when the facemask 400 is worn. The facemask 400 is attached to the person's face 515 via a strap (or multiple straps) 116. In the present embodiment, at least 75% of the nose 510 and the mouth 504 are viewable through the facemask 400 by an onlooker 438 essentially facing the person 500 wearing the facemask 400. The facemask perimeter 406 compresses against the person's face 515 along the bridge 512 of the nose 510 along their cheeks 514 and either on or along their jawline 506. In the present embodiment, there are no other perforations 408 (hidden in FIG. 7) penetrating the face covering cup 401 more than 1 inch from the cup periphery 402 (of FIG. 5). Likewise, there are no perforations 408 in the face covering cup 401 that are within 1 inch from the facemask midpoint 424. Some embodiments envision no perforations 408 in the face covering cup 401 that are within 1.5 inch from the facemask midpoint 424, while other embodiments envision no perforations 408 in the face covering cup 401 that are within 1.0 inches from the facemask midpoint 424.

Figure 8:
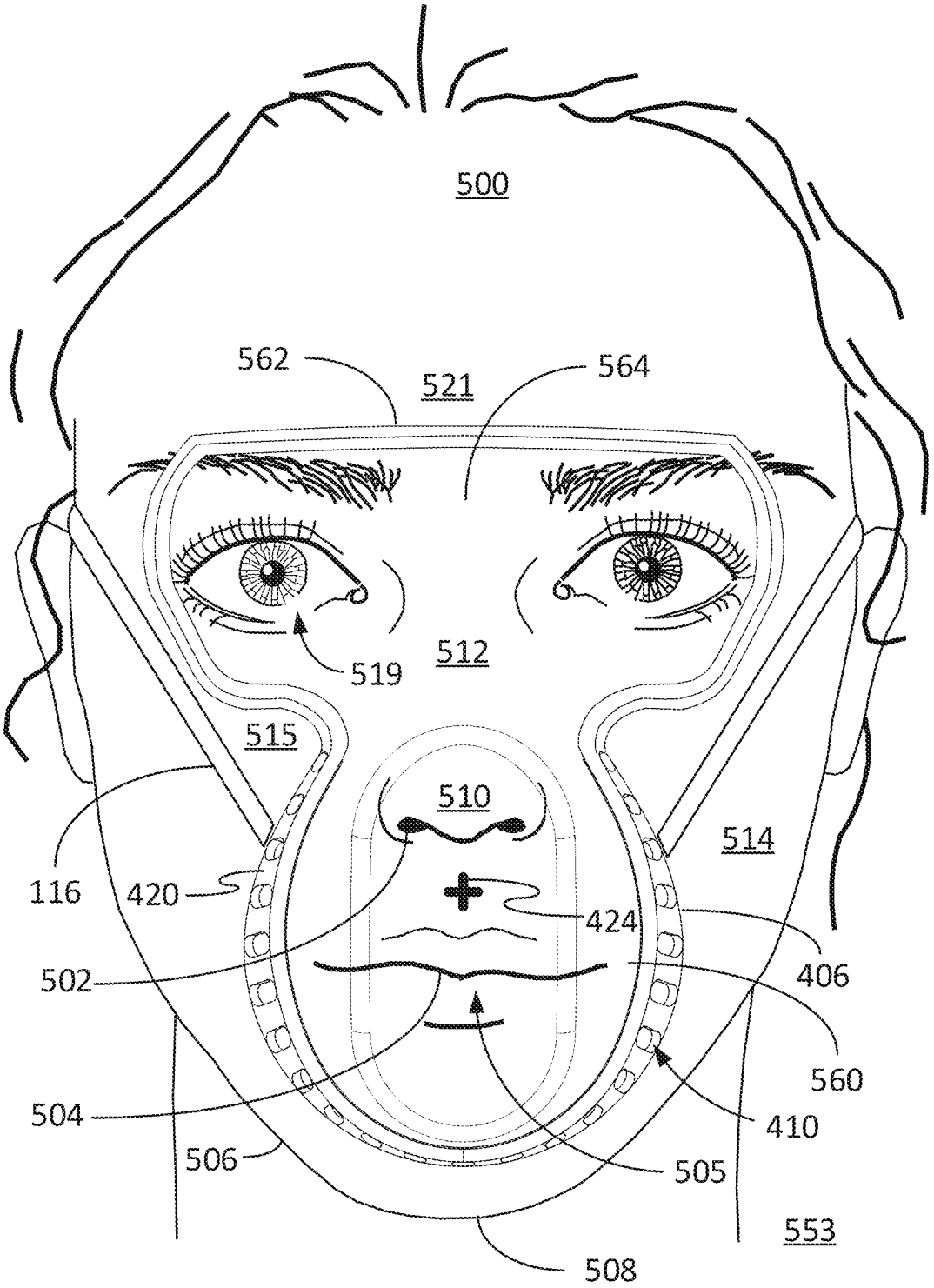
FIG. 8 illustratively depicts yet another embodiment of the gasket facemask with an integrated eye shield consistent with embodiments of the present invention.

FIG. 8 illustratively depicts yet another embodiment of the gasket facemask with an integrated eye shield consistent with embodiments of the present invention. In this embodiment, the clear mask embodiment 560 includes an integrated eye covering 564, which in certain embodiments is formed from a unitary piece of clear material with the face covering cup/eye system. This embodiment of an integrated eye shield facemask 560 protects the eyes 519, the nose 510 and the mouth 504. The unitary goggle portion 564 extends to the person's forehead 521 along an eye covering periphery 562. The integrated goggles 564 provide added protection cutting off any entry place for a virus, bacteria or other particles that may harm a person 500.

Figure 9:
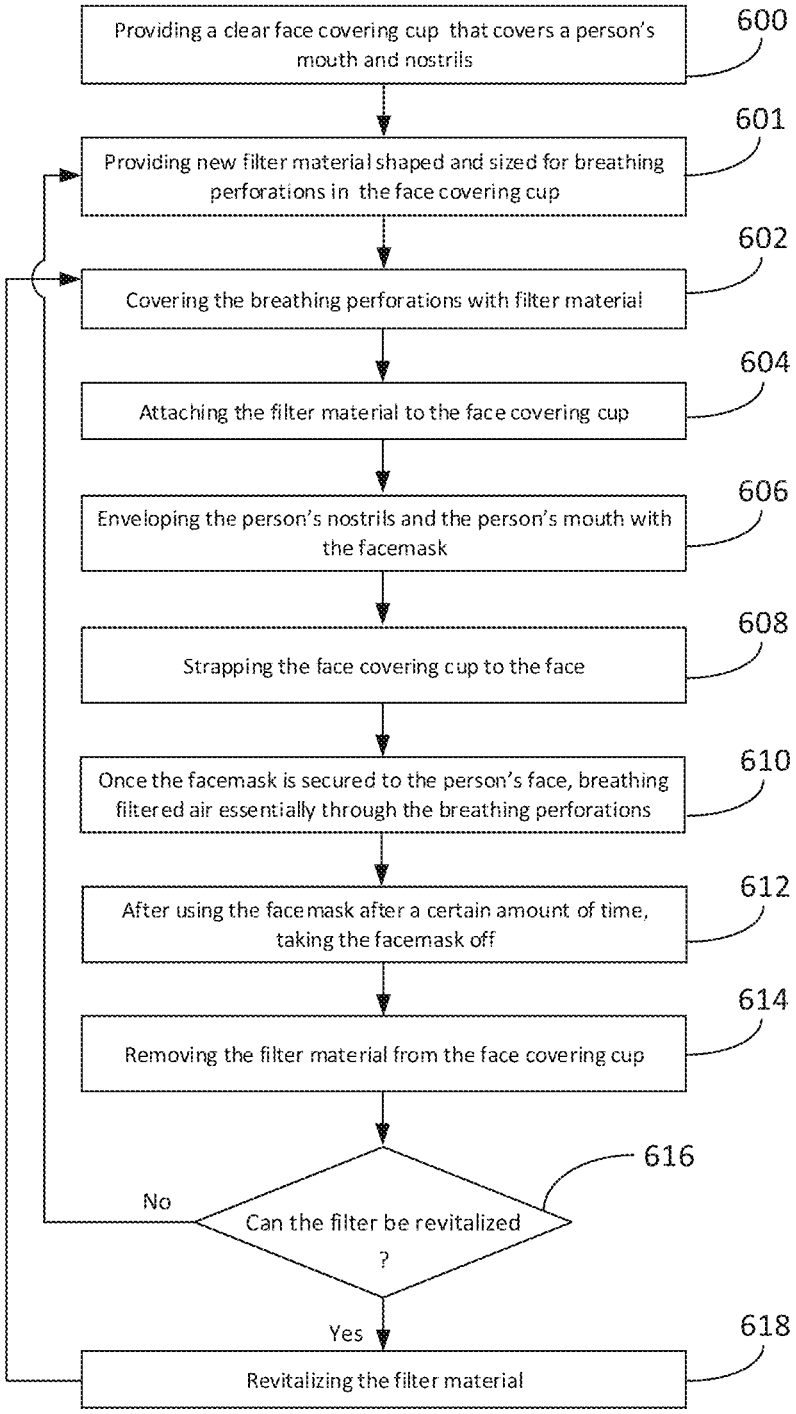
FIG. 9 is a block diagram of a method for attaching a filter band to a facemask consistent with embodiments of the present invention.

FIG. 9 is a block diagram of a method for attaching a filter band to a facemask consistent with embodiments of the present invention. Generally speaking, an embodiment of a facemask 400 is provided including a base covering cup 401 with the plurality breathing perforations 408 that penetrate through the face covering cup 401 within 1 inch of a cup periphery 402, step 600. In step 601, filter material is provided, which in some embodiments is a filter band 405. Step 602 is a step for covering the breathing perforations 408 with filter material 405. Next, the filter material 405 is attached to the face covering cup 401, step 604. This can be accomplished by affixing a filter cover 422 to the facemask 400, the filter cover 420 essentially covering the band of filter material 405 and the cup periphery 402. Accordingly, the band of filter material 405 is interposed between the filter cover 420 and the cup periphery region 428. With the facemask filter material 405 attached to the base covering cup 401, place the facemask 400 on a person's face 515 to at least envelope the person's nostrils 502 and mouth 504, step 606. Strap the face covering cup 401 to the person's face 515, step 608. Once the facemask 400 is secured to the person's face 515, the person 500 breaths filtered air 410 in a passive manner essentially through the breathing perforations 408, step 610. When using the facemask 400 after a certain amount of time, taking the facemask off, step 612, and removing or otherwise disengaging the filter material 405 from the face covering cup 401, step 614. Some embodiment envision a reposable filter system wherein the filter needs to replaced after a predetermined number of uses or amount of use time. Given this, step 616 is a decision step asking if the filter 405 can be revitalized (some filters are not intended to be revitalized, hence it a new one must replace the old one). If the filter 405 is not able or intended to be revitalized, proceed to step 601 and repeat. If the filter 405 is able or intended to be revitalized, proceed to step 618. Step 618 is a block step instructing revitalization of the breather filter via techniques previously described. Next, go to step 602 and repeat by attaching the revitalized filter band 405 as was originally done instead of a new breather filter from step 601. In other words, bypass step 601. The steps can be repeated and the facemask cup 401 and/or filter cover 420 can be washed with soap and water, alcohol, etc., between replacing the filter band 405 if indeed the filter 405 is able to be revitalized.

Figure 10:
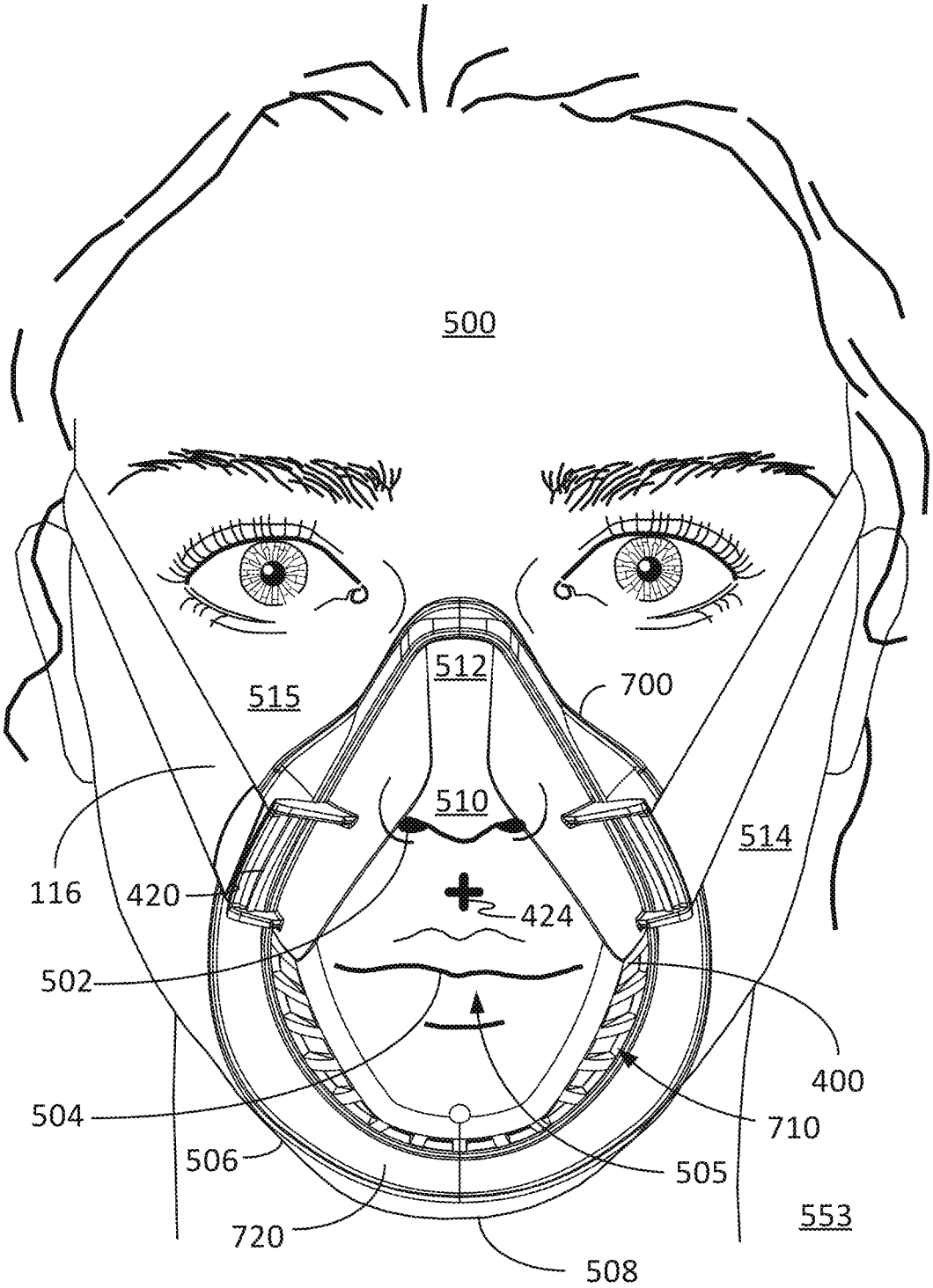
FIG. 10 illustratively depicts an optional embodiment of a passive transparent facemask consistent with embodiments of the present invention.

FIG. 10 illustratively depicts an optional embodiment of a passive transparent facemask consistent with embodiments of the present invention. FIG. 10 is described in conjunction with FIG. 11A, which is an exploded view of the passive transparent facemask of FIG. 10. FIG. 10 is a front view line drawing of a passive transparent facemask 700 being worn by a person 500. The passive transparent facemask 700 covers the person's nostrils 502 and mouth 504, which essentially creates a filtered barrier between the outside environment 553 and the wearer's nostrils 502 and mouth 504 (the inside environment 175 of FIG. 11F). As shown, the facemask 700 is transparent providing an unobstructed view of the person's mouth 504 as seen by an onlooker facing the wearer 500. In the present embodiment, there are no perforations (such as filter perforations 710) penetrating the face covering cup 701 within 1.25 inches of a facemask midpoint 424. When a person 500 wears the facemask 700, the facemask midpoint 424 is located directly in front of the person's face 515 equidistant between the person's nostrils 502 and mouth 504, as shown. Air 418 is exchanged in and out of the facemask 700 via air filter perforations 710 located in the facemask 700 over the person's chin 508 and cheeks 514. In the present embodiment, the facemask 700 is essentially sealed against the person's face 515 by way of a flexible gasket 720. To help preserve a clear view of the person's face 515 (when viewed by an onlooker 438), certain embodiments contemplate an anti-fog coating on the facemask interior surface 776 (as shown in FIG. 11F). Yet, other embodiments contemplate antibacterial and/or antiviral coatings on the facemask 700. The facemask 700 is secured against the person's face 515 by way of an elastic head strap 116 that loops around the person's head. The head strap 116 is secured to head strap anchors 420 located on either side of the facemask midline 422.

Figure 11A:
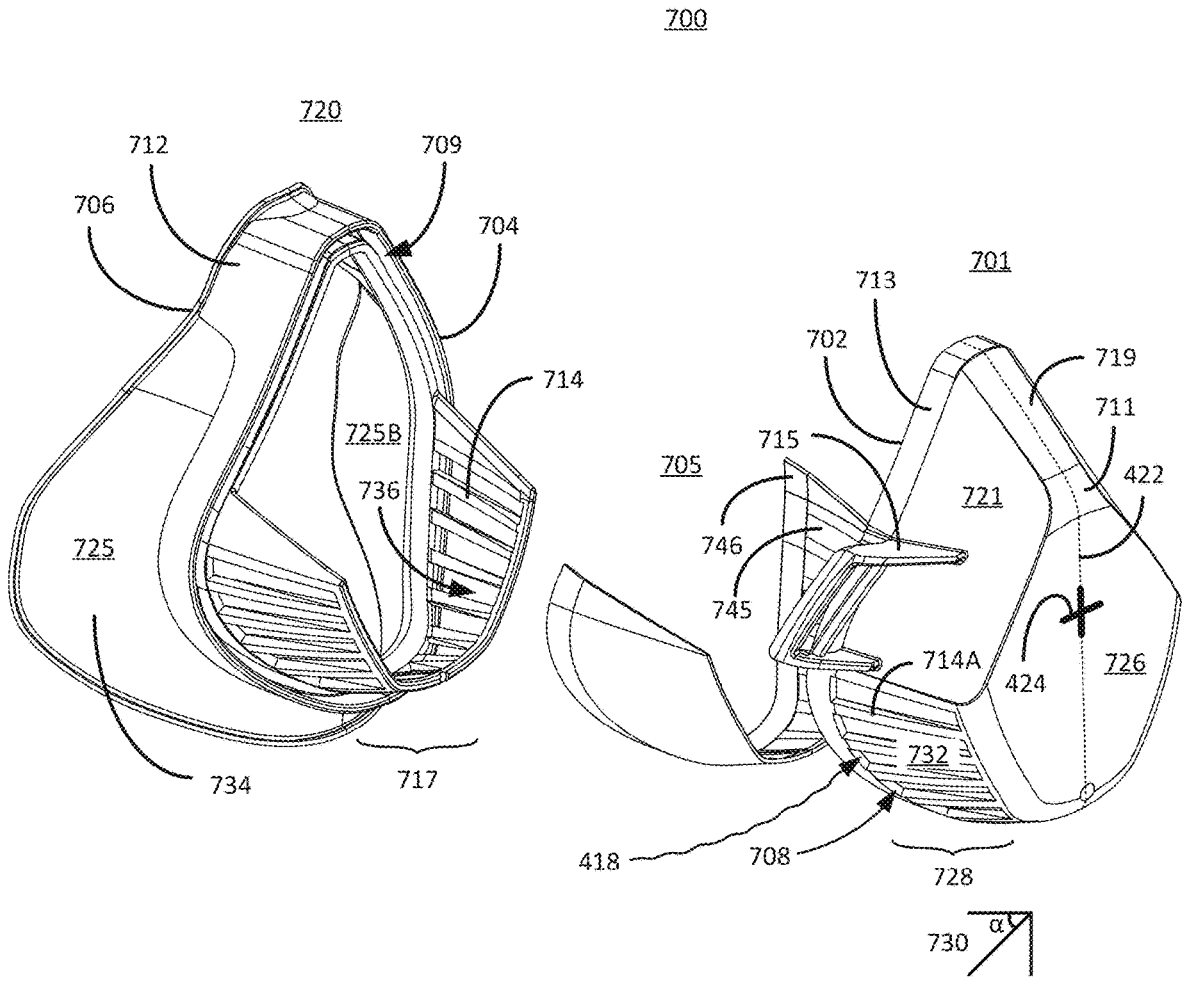
FIG. 11A is an exploded view line drawing of the passive transparent facemask of FIG. 10 consistent with embodiments of the present invention.

Regarding the exploded view line drawing of the passive transparent facemask 700 of FIG. 11A, shown therein are three major elements; a transparent face covering cup 701, a breather filter 705, and a filter cover and contact rim 720. With attention to the transparent face covering cup 701, as shown in the present embodiment the face covering cup 701 generally comprises a front panel 726, a nose covering portion 719, two side panel 721, and a filter port region 728. In the present embodiment, the front panel 726 can be a flat front panel or optionally a slight convex arced front panel, for example. The nose covering portion 719, the two side panels 721 and the filter port region 728 extend from the front panel 726 and terminating at a cup periphery 702, thus forming a cup shape. In the embodiment where the front panel 726 is flat (or nearly flat), distortion of a person's lips 505 and mouth 504 is reduced due to the essentially flat surface. The nose covering portion 719, the two side panels 721, and the filter port region 728 extend from the cup periphery 702 at sufficient distance to the front panel 726 so that when the facemask 700 is worn there is no contact between the front panel 726 and the wearer's mouth 504 and nose 510. Certain embodiments contemplate the filter port region 728 being essentially a curved (chin covering) wall 732 extending from the front panel 726 to the cup periphery 702 at an angle $\alpha$ 730 between 90 degrees and 45 degrees, as shown. This face covering cup embodiment 701 further comprises a cuff 713, or rim, which is a band that extends essentially at a right angle towards the front panel 726, as shown. In the present embodiment, the nose covering portion 719 meets the front panel 726 via a transition nose portion 711. As shown, head strap anchors 715, which are configured to cooperate with the head strap 116, are disposed on each of the side panels 721. The filter port region 728 arcs around the bottom panel of the transparent face covering cup 701. The filter port region 728 comprises a plurality of face covering cup slotted apertures 708 (or holes) defined by face covering cup ribs 714A. The face covering cup slotted apertures 708 are openings, or through slots, in the face covering cup 701 through which the environment outside 553 of the face covering cup 701 cooperates with the inside environment 175 of the face covering cup 701. In that light, outside air 418 (shown by the wavy the arrow) can pass through the slotted apertures 708 into the interior portion of the face covering cup 701. FIG. 11F specifically shows the interior environment 175 defined by the interior surfaces the facemask 700. For reference, the facemask midline 422 (dotted line) and the facemask midpoint 424 (thick cross) are shown. Certain embodiments envision the face covering cup 701 being a unitary element, whether rigid (or essentially rigid, such as clear plastic) or pliable, that can be molded from a clear plastic, such as PVC or some other suitable material known to those skilled in the art. By unitary it is meant that the face covering cup 701 is made of one material and molded from a single sheet or piece of clear plastic and is not formed from several different pieces of plastic or other material welded together.

In the present embodiment, the breather filter 705 can simply be a sheet of flexible filter material or optionally a semi-rigid U-shaped filter element that closely conforms to the filter port region 728. As shown in this embodiment, the breather filter 705 is a U-shaped filter element that is made semi-rigid by a supporting structure 746 with structures that mate or otherwise conform to the filter port region 728. The semi-rigid supporting structure 746 can be plastic, or filter material impregnated with a stiffening binder, such as glue for example. The breather filter 705 is held in place over the filter port region 728 via the filter and contact rim 720.

The filter cover and contact rim 720 comprises a filter cover 717, cuff recess slot 709 and a contact rim 734. In the present embodiment, the contact rim 734 can be a pliable polymer that flexes to conform to the shape of a person's face 515 to essentially create a seal so that the only air passing into and out from the facemask 700 is by way of the filter slots 736 and 708. The filter cover and contact rim 720 can be a unitary element constructed from a single piece of material. Optional construction of the filter cover and contact rim 720 envisions a composite construction. The filter cover and contact rim 720 can comprise a low durometer flexible flange 725 that conforms to a person's chin 508 and cheeks 514 with a higher durometer flexible nose bridge region 712 and filter cover 717. Yet other embodiments envision the filter cover 717 being a much stiffer plastic material. The filter cover 717 essentially conforms to and covers the curved (chin covering) wall/curved panel 732 of the face covering cup 701. The filter cover 717 comprises a plurality of filter cover ribs 714 that overlay or otherwise align with the face covering cup ribs 714A so that the outside environment 553 is in communication with the inside environment 175 (shown in FIG. 11F) via the filter 705. The filter cover ribs 714 define the filter cover slotted openings 736 that provide a pathway through the filter 705 and into the face covering cup 701 via the mating face covering cup slotted apertures 708. The cuff recess slot 709 is configured to receive the cuff 713 in a mating/cooperating relationship whereby the face covering cup 701 is removably retained or otherwise removably attached to the filter cover and contact rim 720 to essentially form a single unit (single facemask 700). As should be appreciated by the exploded view of FIG. 11A, the breather filter 705 is trapped/wedged between the face covering cup 701 and the filter cover and contact rim 720 when the cuff 713 is engaged and locked in the cuff recess slot 709. In certain embodiments, the cuff recess slot 709 retains the cuff 713 in place due to friction of a rubber surface. Other embodiments contemplate a snap, a magnet, or some other retaining configuration to hold the cuff 713 in the cuff recess slot 709. Certain embodiments envision that the breather filter 705 can be replaced by separating the face covering cup 701 from the filter and contact rim 720. In other words, a used breather filter 705 can be replaced by simply separating the face covering cup 701 from the filter and contact rim 720, putting a new breather filter 705 over the filter port region 728 (or optionally cradled in the filter cover 717), and then reattaching the face covering cup 701 to the filter and contact rim 720.

Figure 11B:
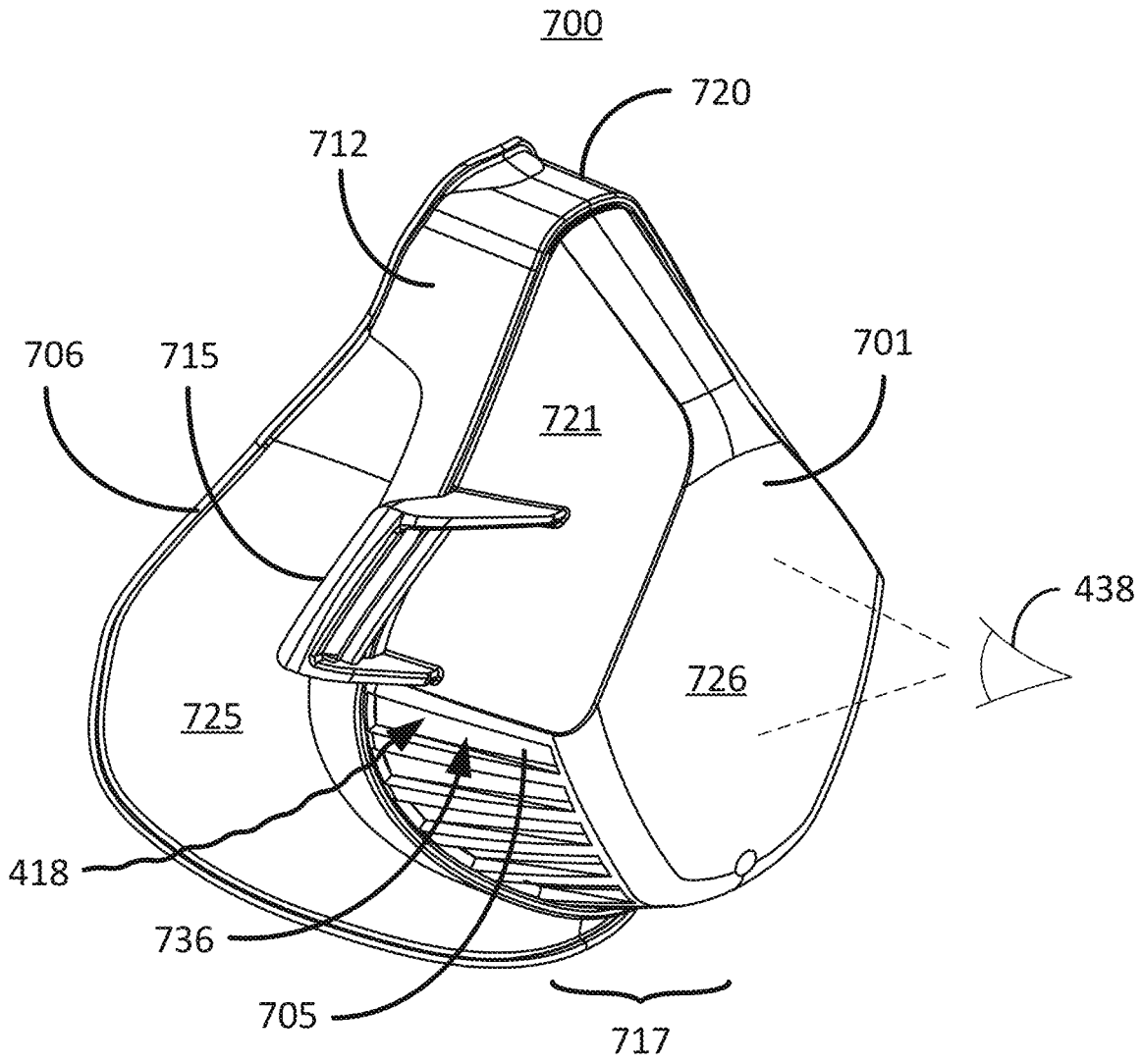
FIGS. 11B-11F are line drawings of the facemask embodiment of FIG. 11A with varying views consistent with embodiments of the present invention.

FIG. 11B is an isometric line drawing view of a fully assembled passive transparent facemask embodiment of FIG. 11A consistent with embodiments of the present invention. As shown, and onlooker 438 facing the facemask's front panel 726, and more specifically a person 500 wearing the facemask 700, can see the wearer's mouth 504 without obstruction through the transparent front panel 726. Outside air 418 passively moves into the facemask 700 via the filter slots 736 through the filter material 705 and by way of the slotted apertures 708 (not visible in this figure) when the wearer 500 breaths. In the present embodiment, the orthogonal distance from the front panel 726 to a cup back plane is at least 1.5 inches and in other embodiments is between 2 inches and 3 inches. The cup back plane is defined by a plane along (that rests atop) the cup periphery 702 (of FIG. 11A). Also as shown in this embodiment, the filter cover 717 extends essentially from between 3:00 and 9:00 on a panel under and to the sides of the front panel 726. The head strap anchors 715 can be molded as (a unitary) part of the face covering cup 701 or can optionally be a separate element fixedly attached to the side panels 721 by a mechanical snap, glue, or some other attachment scheme known to those skilled in the mechanical arts. The flexible flange 725 can be clear or opaque and has a sufficiently low durometer and resilience to deform in order to conform to a wearer's face 515. Certain other embodiments envision the nose bridge region 712 being a higher durometer material than the flexible flange 725, while other embodiments envision the nose bridge region 712 and the flexible flange 725 being a unitary piece of common material, all with the same durometer. The present embodiment further includes a perimeter lip/bead 706 that extends along the outer border (free edge) of the filter and contact rim 720.

Figure 11C:
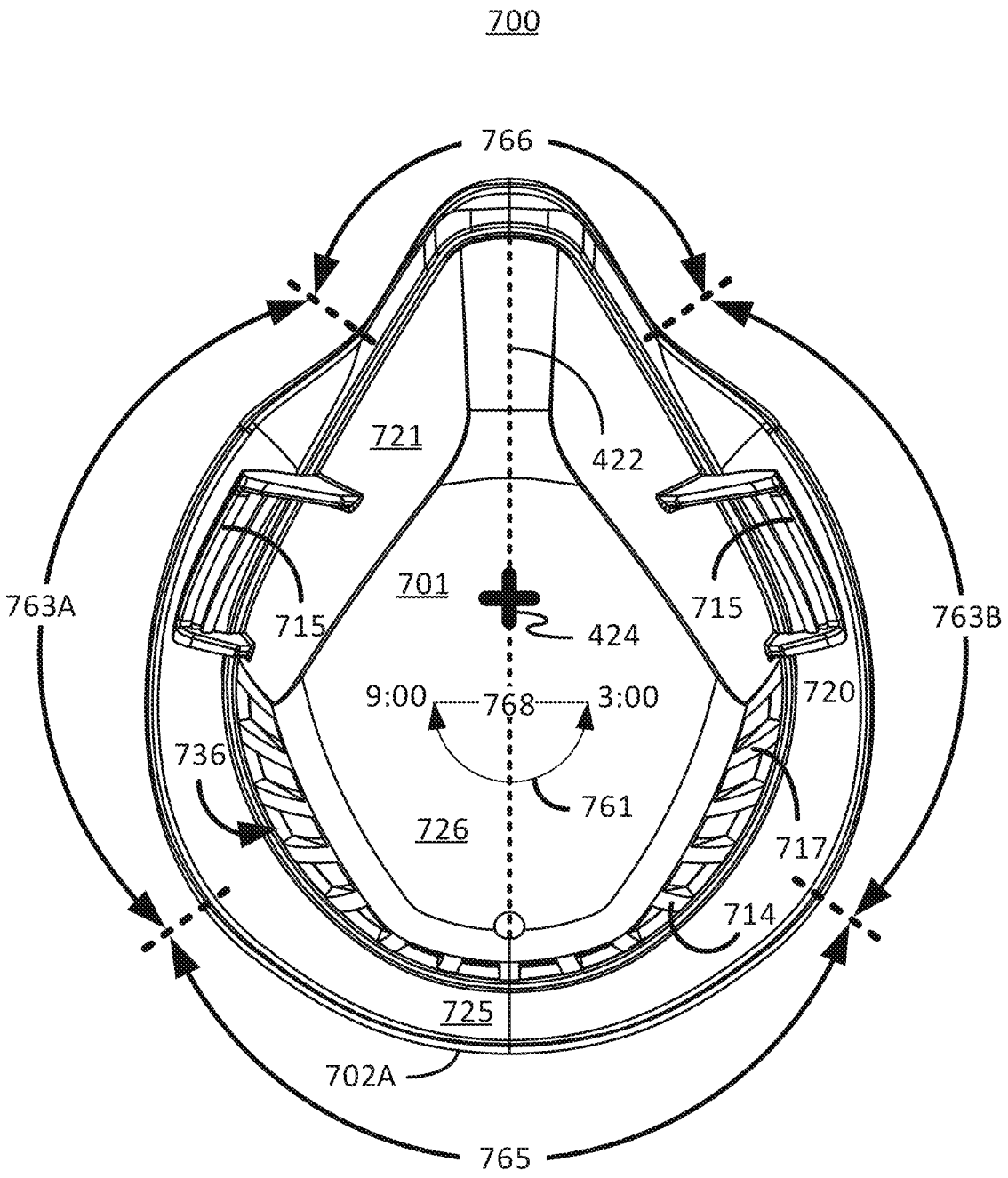

FIG. 11C is a front view line drawing of the passive transparent facemask 700. As shown from this perspective, flexible flange 725 flares laterally to fit around a person's cheeks 514 and chin 508. The filter cover 717 extends along a person's chin 508 and cheek 514 from 3:00-9:00 (analogy being a clock) as defined over a mouth location 768 and shown by the half circle double arrow 761. As previously discussed, air from the outside can pass in through the filter slots 736 defined by the filter cover ribs 714. For reference, the facemask midline 422 and the facemask midpoint 424 are shown in the front panel 726 and the head strap anchors 715 are extending from the side panels 721. For descriptive purposes, the cup periphery 702A can be divided via a nose periphery region 766, which is adapted to traverse the bridge 512 of the wearer's nose 510, a pair of cheek periphery regions 763 adapted to traverse along their cheeks 514, and a chin periphery region 765 adapted to traverse along or above the wearer's jawline 506. For reference, the face covering cup 701 illustratively shows the midline 422 that bisects the face covering cup 701 midway between the nose periphery region 766 and the chin periphery region 765.

Figure 11D:
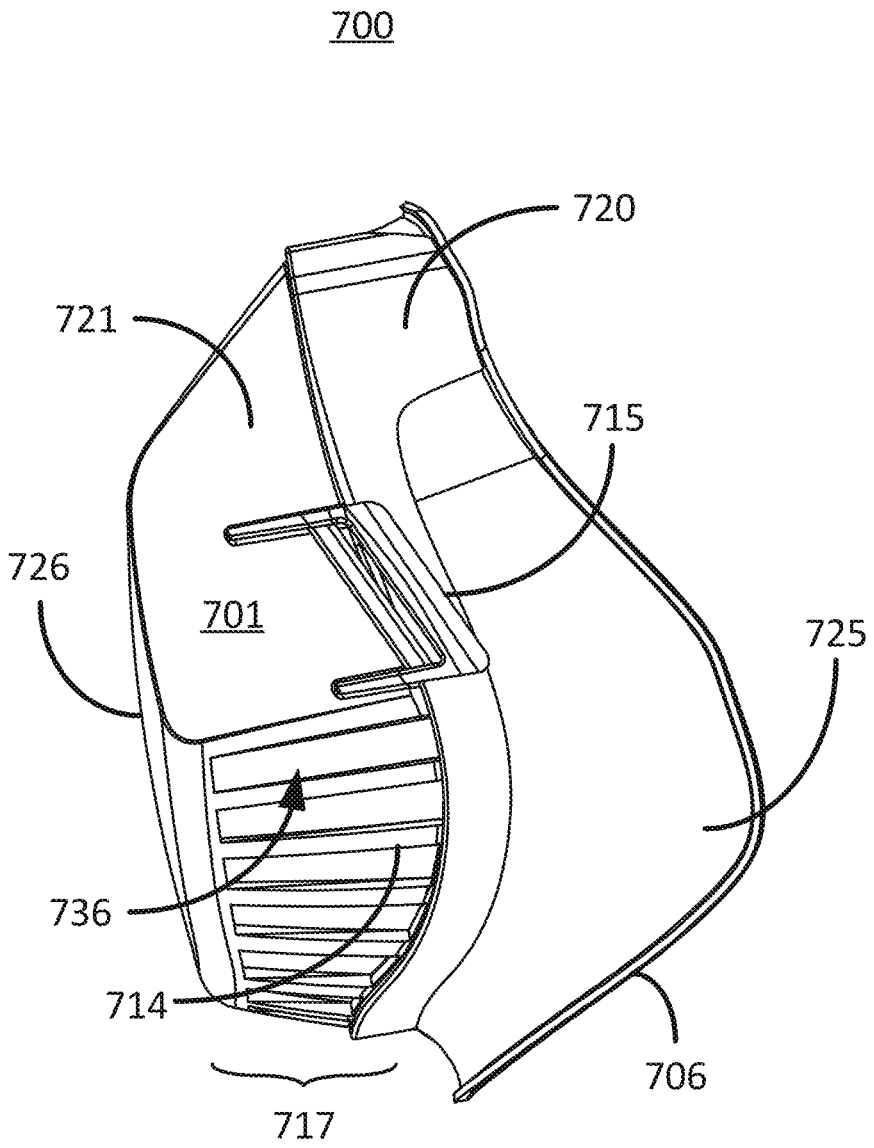

FIG. 11D is a side view line drawing of the passive transparent facemask 700. The flaring shape of the flexible flange 725 is prominently shown with the perimeter lip 706 extending around the edge of the filter and contact rim 720. The transparent front panel 726 is shown slightly convex in shape (like a lens), but could just as easily be essentially flat, as previously discussed. One of the head strap anchors 715 is shown extending from a side panel 721. Also, the filter cover 717 prominently shows the filter slots 736 and the filter cover ribs 714 traversing the lower half of the face covering cup 701.

Figure 11E:
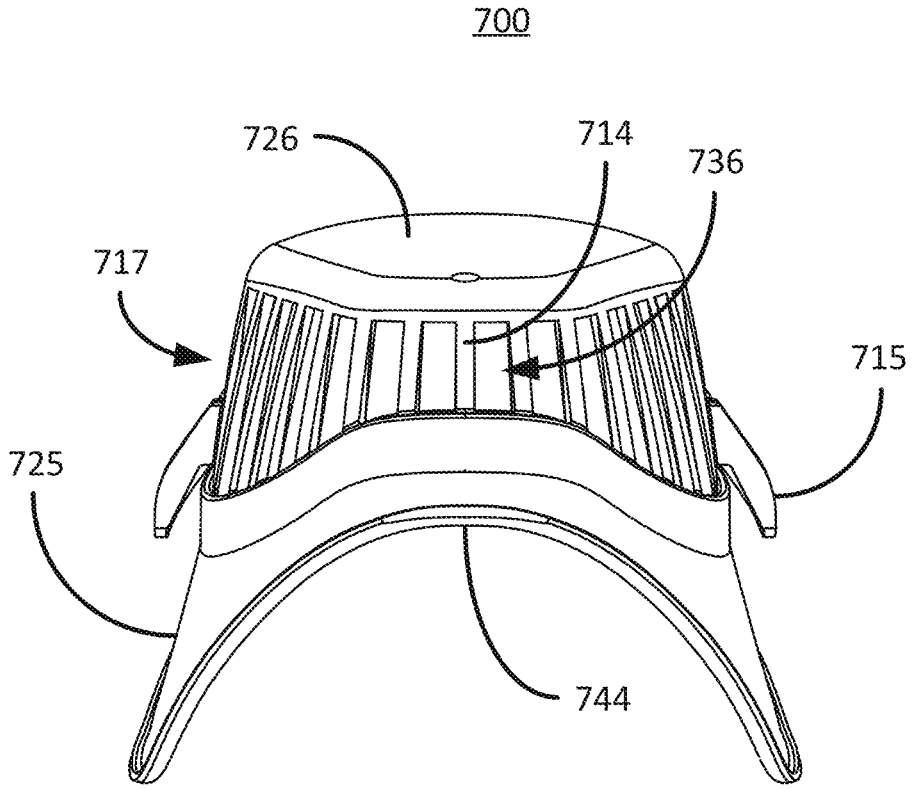
Figure 11F:
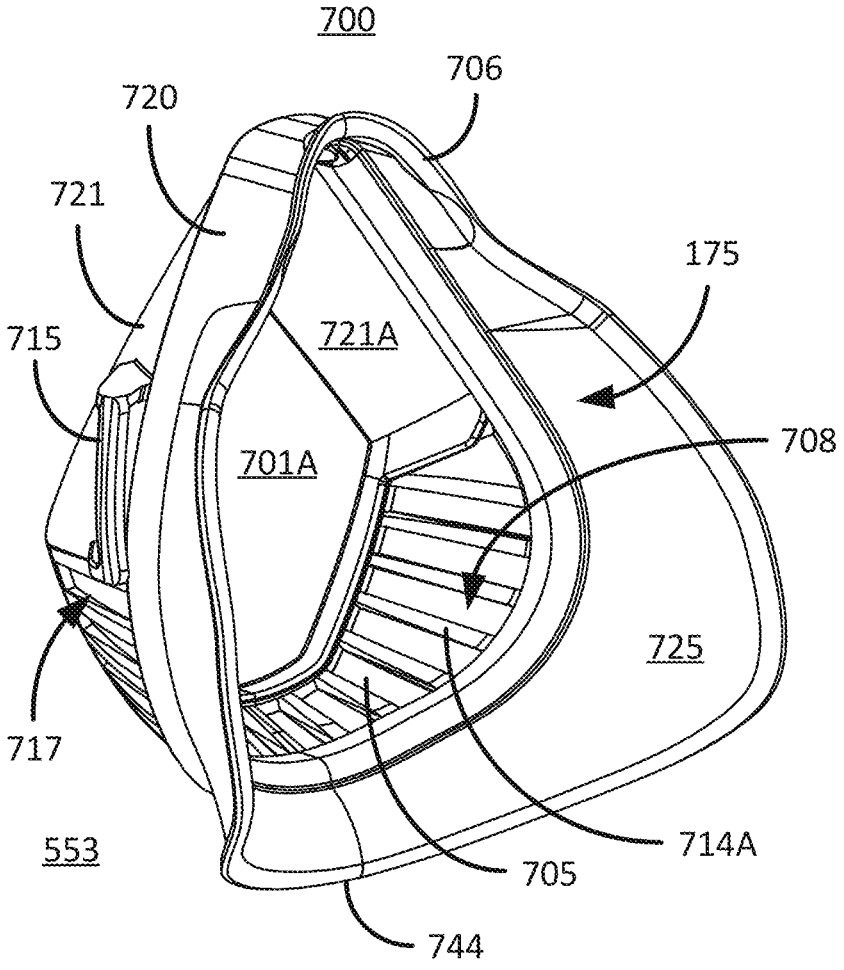

FIG. 11E is a bottom view line drawing of the passive transparent facemask 700 prominently showing the filter cover 717 defined by the filter cover slots 736 between the filter cover ribs 714. The bottom view of the two head strap anchors 715 are just above the flexible flange 725. As shown in this perspective, the transparent front panel 726 is slightly convex in shape.

FIG. 11F is a back view isometric line drawing of the passive transparent facemask 700 revealing the interior environment 175, the cup inside surface 701A. Below the interior surface of the side panel 721A are the face covering cup ribs 714A (in the bottom curved panel 728, labeled FIG. 11A) that define the face covering cup slotted apertures 708 better communication with the outside environment 553 by way of the breather filter 705. A portion of the filter cover 717 is shown on the outside of the face covering cup 701. Also for reference, one of the head strap anchors 715 is depicted outwardly extending from the side panel 721. From this perspective, a skilled artisan will appreciate that the perimeter lip 706 is shaped to conform and help seal against the person's face 514. With reference to the filter cover and contact rim 720, the perimeter chin region 744 on the lower side of the flexible flange 725 is shaped to cup just above the person's jaw line 506.

With the present description in mind, below are some examples of certain embodiments illustratively complementing some of the methods and apparatus embodiments to aid the reader. The elements called out below are examples provided to assist in the understanding of the present invention and should not be considered limiting.

In that light, one embodiment of the present invention envisions a gasket facemask 100 comprising: a face covering cup 101 configured to cover both a human mouth and nostrils, the face covering cup 101 is defined by a cup periphery 102 that is adapted to traverse the bridge of a person's nose along their cheeks and jawline, the face covering cup 101 comprising at least one breather port 135; a breather port filter 110 covering the at least one breather port 135; a pair of head strap attachment anchors 115 located between the cup periphery 102 and the at least one breather port 135, the head strap attachment anchors 115 located symmetrically on either side of the at least one breather port 135, the pair of head strap attachment anchors 115 adapted to anchor at least one head strap 116 thereto; and a filter gasket 105 attached to the entire cup periphery 102, the filter gasket 105 configured to intimately contact a human face along a filter-to-face contact periphery 106.

The gasket facemask embodiment further envisioning wherein the filter gasket 105 comprises a gasket channel 108 that receives the cup periphery 102.

The gasket facemask embodiment further comprising a filter gasket armature 130 that covers the cup periphery 102, the filter gasket 105 covers the filter gasket armature 130, the filter gasket armature 130 configured to provide structure to improve a contact seal of the filter-to-face contact periphery 106. This embodiment further contemplating wherein the gasket filter armature 130 is pliable. Alternatively, this embodiment further contemplating wherein the gasket filter armature 130 comprises an armature channel 132 that receives the cup periphery 102.

The gasket facemask embodiment 100 further contemplating wherein the filter gasket 105 is a fibrous material that filters out bacteria and/or viruses.

The gasket facemask embodiment 100 further comprising a breather port filter frame 125 that connects the breather port filter 110 to the facemask 101.

The gasket facemask embodiment 110 (200) further comprising an oxygen intake port 220 that extends through the face covering cup 101. This embodiment further contemplating wherein the intake port 220 is located in a nose portion 120 of the face covering cup 101. Alternatively, this embodiment further contemplates wherein the intake port 220 possesses a nozzle 230 configured to connect to an oxygen tube.

Yet another embodiment of the present invention envisions a method for using a filtration gasket facemask 100, the method comprising: providing a filtration gasket facemask 100 that generally includes a face covering cup 101 defined by a cup periphery 102, at least one breather port 135 perforating the face covering cup 101, a breather port filter 110 covering the at least one breather port 135, a head strap connected to a pair of head strap attachment anchors 115, a filter gasket 105 attached to the entire cup periphery 102, the filter gasket 105 is at least partially comprised of a permeable filtration material; strapping, via an elastic strap 116, the filtration gasket facemask 100 onto a human face over nostrils and mouth of the human face with a filter-to-face contact periphery 106 of the filter gasket 105 contacting the human face along the entire filter-to-face contact periphery 106; and at least inhaling or exhaling 136/138 solely through the breather port filter and the filter gasket 105.

The method embodiment further contemplating wherein the filtration gasket facemask 200 further comprising an oxygen intake port 220 that extends through the face covering cup 101. This embodiment further contemplating wherein the intake port 220 is located in a nose portion 120 of the face covering cup 101. Alternatively, this embodiment further comprising flowing oxygen enriched air into the filtration gasket facemask 200 via the oxygen intake port 220.

Another embodiment envisions a gasket facemask 400 comprising: a face covering cup 401 configured to cover both a human mouth 504 and nostrils 502, the face covering cup 401 is defined by a cup periphery 402 that is adapted to traverse the bridge 512 of a person's nose 510 along their cheeks 514 and at or above their jawline 506, the face covering cup 401 further defining a midline 422 that bisects the face covering cup 401 along the human mouth 504 in between the nostrils 502; a plurality of breathing perforations 408 dispersed in the face covering cup 401 along the cup periphery 402; a filter band 405 configured to cover the breathing perforations 408, exchange of air 418 can essentially only occur through the breathing perforations 408 via the filter band 405; a pair of head strap attachment anchors 415 located on either side of the midline 422, each strap attachment anchor 415 located between the cup periphery 402 and the midline 422, the pair of head strap attachment anchors 415 are adapted to cooperate with at least one head strap 116 in an anchored relationship.

The gasket facemask embodiment 400 further comprising a filter cover 420 that mechanically retains (fixes) the filter band 405 to the face covering cup 401.

The gasket facemask embodiment 400 further contemplating wherein the filter cover 420 comprises a plurality of filter cover perforations 410 that provide a pathway to the breathing perforations 408 via the filter band 405. This embodiment further envisioning wherein the filter cover perforations 410 are located between a face contact rim 406 and a mask periphery 404. Optionally the embodiment envisioning wherein there is a filter cover gap 436 between an interior filter cover surface 434 and the filter band 405. These embodiments further envisioning wherein the filter cover gap 436 is less than 0.025 inches deep.

The gasket facemask embodiment 400 further envisioning wherein the head strap anchors 415 are located on either side of the midline 422 between the cup periphery 402 and the midline 422, between the human mouth and the nostrils.

The gasket facemask embodiment 400 further imagining wherein the filter band 405 is replaceable.

The gasket facemask embodiment 400 further considering wherein the face covering cup 401 is transparent. This embodiment further envisioning wherein the facemask covering cup 401 is configured to provide an unobstructed view of the mouth and nose via an onlooker 438 from outside 440 the facemask 400.

The gasket facemask embodiment 400 further envisioning wherein the filter band 405 is reposable.

The gasket facemask embodiment 400 further imagining wherein the breathing perforations 408 are dispersed less than 0.75 inches from the cup periphery 402.

Yet another embodiment can include a method for attaching a filter band 405 to a facemask 400, the method comprising: providing a face covering cup 401 with a plurality of breathing perforations 408 that penetrate through the face covering cup 401 within one inch of a cup periphery 402; covering the breathing perforations 408 with filter material 405; attaching the filter material 405 to the face covering cup 401; enveloping a nose and mouth with the facemask 400, the nose and the mouth belonging to a face at least 75% of the nose and the mouth viewable through the facemask by an onlooker essentially facing the facemask 400; strapping the face covering cup 401 to the face 515; breathing air 418 through the breathing perforations 408 only through the filter material 405.

The method embodiment further comprising affixing a filter cover 420 to the facemask 400, the filter cover 420 essentially covering the filter material 405 and the cup periphery 402. The embodiment can further comprise affixing a filter cover 420 to the facemask 400, the filter cover 420 essentially covering the filter material 405 and the cup periphery 402. Optionally, this can further comprise disengaging the filter cover 420 from the facemask 400, removing the filter material 405 from the face covering cup 401, revitalizing the filter material 405, reattaching the filter material 405 to the face covering cup 401 by clamping the filter cover 420 to the facemask 400. Optionally, this can further comprise forcing at least 95% of the air 418 breathed through the breathing perforations 408 by way of a gasket 120 that presses along the face after the strapping step, the gasket defined along a filter cover periphery of the filter cover 420.

The method embodiment further envisioning wherein there are no other perforations penetrating the face covering cup 401 more than one inch from the cup periphery 402.

The method embodiment further comprising disengaging the filter material 405 from the face covering cup 401, revitalizing the filter material 405, and reattaching the filter material 405 to the face covering cup 401.

Still other embodiments contemplate a periphery air filtered facemask 400 comprising: a face covering cup 401 configured to cover both a human mouth and nostrils, the face covering cup 401 is defined by a cup periphery 402 that is adapted to traverse the bridge of a person's nose along their cheeks and at or above their jawline, a plurality of breathing perforations 408 in the face covering cup 401, none of the breathing perforations into the face covering cup 401 are within 1.25 inches of a mask midpoint 424, the mask midpoint 424 defined as a point equidistant between the nostrils 502 and the mouth 504; a filter band 405 that covers the breathing perforations 408, through the filter is the only pathway into the breathing perforations 408 from an outside environment; a filter cover 420 that locks the filter band 405 in place over the breathing perforations 408.

Some alternate embodiments contemplate a passive transparent respirator assembly 150 comprising: a transparent face covering cup 101 comprising a nose covering region 120 configured to cover human nostrils 502 and at least a portion of a human nose 510, a mouth covering region 117 configured to completely cover a human mouth 504 without any external viewable obstruction to the human mouth 504 when the human mouth 504 is closed, a chin covering region 119 configured to cover at least a portion of a human chin 508, and two cheek covering regions 113 located on either side of a midline 422 and configured to cover a portion of a human cheek 514, the midline 422 is defined as bisecting the face covering cup 101 extending along and bisecting the nose covering region 120 and the chin covering region 119, the face covering cup 101 is unitary, the face covering cup 101 is further defined by a cup exterior surface 140 and a cup interior surface 175; at least one aperture 135 extending through the face covering cup 101 from the cup exterior surface 140 to the cup interior surface 175, the at least one aperture 135 covered by at least one filter 110, which together comprise a passive respirator intake pathway 142, there is no other pathway other than the passive respirator intake pathway 142 between the cup exterior surface 140 and the interior surface 175.

The passive transparent respirator assembly embodiment 150 further envisioning wherein the passive respirator intake pathway 142 is only in the chin covering region 119.

The passive transparent respirator assembly embodiment 150 further imagining wherein the passive respirator intake pathway 142 is in the chin covering region 119 and the cheek covering region 113.

The passive transparent respirator assembly embodiment 150 further comprising defining a cup periphery 102 that bridges the cup exterior surface 140 and the cup interior surface 175, the cup periphery 102 is further defined by a lip that extends outwardly from the cup exterior surface 140.

The passive transparent respirator assembly embodiment 150 further comprising defining a cup periphery 102 that bridges the cup exterior surface 140 and the cup interior surface 175, the cup periphery 102 comprising a lip 103 that extends outwardly from the cup exterior surface 140 along at least part of the cup periphery 102.

The passive transparent respirator assembly embodiment 150 further comprising a filter gasket 105 that covers the cup periphery 102. This can further be wherein the filter gasket 105 is a permeable filter material configured to contact a person's face 515 when being worn.

Yet other embodiments contemplate transparent facemask assembly 150 comprising: a face covering cup 101 configured to cover human nostrils 502, a human mouth 504 and at least a portion of a human chin 508 when worn by a human 500, the face covering cup 101 is composed of a pliable and essentially resilient transparent polymer; a filter system 139 comprising at least a breather filter 110 that covers at least an inlet-outlet aperture 135 in the face covering cup 101, no part of the filter system 139 is in a mouth covering region 117, the face covering cup 101 defining the mouth covering region 117 as being configured to essentially cover a closed human mouth 504 when worn, the mouth covering region 117 further comprising an unobstructed transparent window configured to provide an unobstructed view of the human mouth 504 when closed as viewed by an onlooker 438.

The transparent facemask assembly embodiment 150 further imagining wherein the breather filter 110 is attached to the face covering cup 101.

The transparent facemask assembly embodiment 150 further considering wherein the face covering cup 101 is a unitary element.

The transparent facemask assembly embodiment 150 further envisioning wherein the transparent polymer is essentially clear.

The transparent facemask assembly embodiment 150 further contemplating wherein the transparent facemask assembly 150 is a passive facemask.

The transparent facemask assembly embodiment 150 is further visualized wherein the face covering cup 101 further defining a chin covering region 119 as being configured to cover a human chin 508 when worn, the chin covering region 119 is below the mouth covering region 117, the filter system 139 resides in the chin covering region 119. This can further be wherein the filter system 139 further resides in a cheek covering region 113 of the face covering cup 101, the cheek covering region 113 is configured to cover at least a portion of a human cheek 113.

The transparent facemask assembly embodiment 150 further conceptualizing wherein the face covering cup 101 is further defined by a cup periphery 102 that bridges a cup exterior surface 140 and the cup interior surface 175, the cup periphery 102 comprising a lip 103 that extends outwardly from the cup exterior surface 140 along at least part of the cup periphery 102. This can further comprise a filter gasket 105 that covers the cup periphery 102.

While still yet other face covering cup embodiments 101 can comprise: a nose covering region 120 that is configured to cover human nostrils 502 and at least a portion of a human nose 510, a mouth covering region 117 configured to essentially cover a human mouth 504 and human lips when worn and when the human mouth 504 is closed, a chin covering region 119 configured to cover at least a portion of a human chin 508; at least one air exchange aperture 135 in the face covering cup 101, the at least one air exchange aperture 135 located in the chin covering region 119 and not in the mouth covering region 117, a filter 110 configured to cover the at least one air exchange aperture 135, no part of the mouth covering region 117 obstructed by the filter 110, the face covering cup 101 is composed of a resilient transparent polymer.

The face covering cup embodiment 101 further defining a cup center point 424 residing between the wearer's nostrils 502 and mouth 504 and in line with a centerline 422 that bisects the face covering cup 101 along the nose covering region 120 and the chin covering region 119, the cup center point 424 at least 1 inch from the chin covering region 119.

The face covering cup embodiment 101 further envisioning wherein the mouth covering region 117 is not obscured by any part of a facemask assembly 150 including the filter 110.

The face covering cup embodiment 101 further considers the idea that the face covering cup 101 is exclusively part of a passive facemask 100.

While still other embodiments contemplate a passive transparent facemask 700 comprising: a face covering cup 701 configured to cover a mouth 504 and nostrils 502 of a wearer 500 with a mask midpoint 424 defined as a point on the face covering cup 701 that is equidistant between the mouth 504 and the nostrils 502 when the facemask 700 is worn, the face covering cup 701 is defined by a cup periphery 702 that is further defined by a nose periphery region 766 adapted to traverse the bridge 512 of a nose 510 of the wearer 500, a pair of cheek periphery regions 763 adapted to traverse along cheeks 514 of the wearer 500 and a chin periphery region 765 adapted to traverse along or above a jawline 506 of the wearer, the face covering cup 701 further defining a midline 422 that bisects the face covering cup 701 midway between the nose periphery region 766 and the chin periphery region 765; a plurality of breathing perforations 708 dispersed in the face covering cup 701 at a distance greater than 1.25 inches from the midpoint 424; and at least one filter 705 that covers the breathing perforations 708, exchange of air 418 can essentially only occur through the breathing perforations 708 via the at least one filter 705.

The passive transparent facemask embodiment 700 further imagining wherein the breathing perforations 708 extend along the cup periphery 702 along the chin periphery region 765 and at least a portion of the cheek periphery regions 763. This can further be wherein the breathing perforations 708 extend essentially from 3:00-9:00 as defined by a mouth location 768 on the face covering cup 701, the mouth location 768 is defined by where the mouth 504 would be located if the face covering cup 701 were worn by the wearer 500.

The passive transparent facemask embodiment 700 further envisioning wherein the distance is greater than 1.5 inches from the midpoint 424.

The passive transparent facemask embodiment 700 further considering wherein the filter is a filter band.

The passive transparent facemask embodiment 700 further comprising a filter cover 717 that covers the at least one breathing filter 705. This can further be wherein the breathing perforations 708 are slotted apertures 708 defined by ribs 714A that extend from a face covering cup front panel 726 toward the cup periphery 702 at an angle α 730 between 90 degrees and 45 degrees.

The passive transparent facemask embodiment 700 further comprising a front panel 726 that is essentially flat wherein the plurality of breathing perforations 708 are exclusively in a filter port region 728, the filter port region 728 is essentially a curved wall 732 extending from the front panel 726 to the cup periphery 702 at an angle α 730 between 90 degrees and 45 degrees. This can further be wherein while the passive transparent facemask 700 is being worn, the mouth 504 is configured to be viewable by an onlooker 438 through the front panel 726 without obstruction.

The passive transparent facemask embodiment 700 further comprising a pair of head strap attachment anchors 715 located on either side of the midline 422, each strap attachment anchor 715 located between the cup periphery 702 and the midline 422, the pair of head strap attachment anchors 715 adapted to anchor at least one head strap 116.

Still other embodiments contemplate a passive transparent anti-contagion facemask 700 comprising: a face covering cup 701 comprising a front panel 726 configured to provide an unobstructed view of a human mouth 504 and human nostrils 502 as viewed by an onlooker 438 when the facemask 700 is worn, a curved chin covering panel 732 that extends from the front panel 726 to a cup periphery 702 at an angle α 730 between 90 degrees and 45 degrees, at least one cup perforation 708 through the chin covering panel 732; a filter 705 covering the at least one cup perforation 708; a filter cover and contact rim 720 covering the filter 705, the a filter cover and contact rim 720 comprising at least one filter cover perforation 736 that that is in communication with the at least one cup perforation 708 by way of the filter 705.

The passive transparent anti-contagion facemask embodiment 700 further comprising a flexible flange 725 configured to conform to a wearer's face 515. This can further be wherein the flexible flange 725 is a lower durometer than the face covering cup 701.

The passive transparent anti-contagion facemask embodiment 700 further envisioning wherein the face covering cup 701 is a unitary transparent element.

The passive transparent anti-contagion facemask embodiment 700 further comprising two side cup panels 721 joining the curved chin panel 732 to a nose covering panel 719, the two side cup panels 721, the curved chin panel 732 and the nose covering panel 719 connected to the front panel 726 on a first end and defining the cup periphery 702 on a second end.

The passive transparent anti-contagion facemask embodiment 700 further imagining wherein the at least one cup perforation 708 is a slotted aperture 708 defined by ribs 714A.

A method for using a transparent facemask 700, the method comprising: providing a face covering cup 701 with a plurality of breathing perforations 708 that penetrate through the face covering cup 701; covering the breathing perforations 708 with filter material 705; attaching the filter material 705 to the face covering cup 701; enveloping a human nostrils 502 and human mouth 504 with the facemask 700, the human nostrils 502 and the human mouth 504 viewable by an onlooker 438 without obstruction through a transparent front facemask panel 726, strapping the face covering cup 701 to the face; breathing air 418 through the breathing perforations 708 via the filter material 705, defining a mask midpoint 424 as a point on the face covering cup 701 that is equidistant between the human mouth 504 and the human nostrils 502, the breathing perforations 708 are a distance greater than 1.25 inches from the mask midpoint 424.

The method for using the transparent facemask 700 embodiment further considering wherein the face covering cup further comprises two side cup panels 721 joining a curved chin panel 732 to a nose covering panel 719, the two side cup panels 721, the curved chin panel 732 and the nose covering panel 719 connected to the front panel 726 on a first end and defining cup periphery 702 on a second end, the breathing perforations 708 are solely in the curved chin panel 732. This can further comprise connecting a filter cover and contact rim 720 over the filter material 705, the filter cover and contact rim 720 comprising filter cover perforations 736 that are in communication with the cup perforations 708 by way of the filter 705.

The method for using the transparent facemask 700 embodiment further pondering wherein the transparent front facemask panel 726 is essentially flat.

The above sample embodiments should not be considered limiting to the scope of the invention whatsoever because many more embodiments and variations of embodiments are easily conceived within the teachings, scope and spirit of the instant specification.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, different configurations, thicknesses, permeability, compressibility of the filtered gasket can be used without departing from the scope and spirit of the present invention. Also, though different facemask embodiments can be inventive as a whole, individual facemask components or elements can be equally inventive and stand alone. Further, the terms "one" is synonymous with "a", which may be a first of a plurality.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed.

What is claimed is:

1. A passive transparent respirator assembly comprising:

a transparent face covering cup comprising a front panel configured to provide an unobstructed view of a nose covering region configured to cover human nostrils and at least a portion of a human nose and a human mouth when the human mouth is closed, a curved chin covering panel that extends from the front panel to a cup periphery, a midline bisecting the face covering cup along the nose covering region and the chin covering region, the curved chin covering panel meets the front panel at essentially an acute angle along the midline, at least one breathing perforation extending through the chin covering panel, the at least one breathing perforation configured to be covered by at least one filter, the at least one breathing perforation and the at least one filter further comprising a passive respirator intake pathway.

2. The passive transparent respirator assembly of claim 1, wherein the the face covering cup is unitary.

3. The passive transparent respirator assembly of claim 1 wherein the chin covering region connects to two cheek covering panels.

4. The passive transparent respirator assembly of claim 1, wherein the breathing perforations extend essentially from 3:00-9:00 with the midline at 6:00.

5. The passive transparent respirator assembly of claim 1, wherein the curved chin covering panel is greater than 1.5 inches from the midpoint.

6. The passive transparent respirator assembly of claim 1, wherein the breathing perforations are slotted apertures defined between ribs.

7. The passive transparent respirator assembly of claim 1, wherein the filter is a filter band.

8. The passive transparent respirator assembly of claim 1 further comprising a filter cover that covers the at least one breathing perforation.

9. The passive transparent respirator assembly of claim 1, the at least one breathing perforation is a slotted aperture.

10. The passive transparent respirator assembly of claim 1, wherein the curved chin covering panel is a curved wall and the front panel is essentially flat.

11. A passive transparent anti-contagion facemask comprising:

a face covering cup comprising a front panel configured to provide an unobstructed view of a human mouth and human nostrils as viewed by an onlooker when the facemask is worn;

a midline defined as bisecting the face covering cup, the midline configured to extend between the human nostrils and bisect the human mouth when the facemask is worn;

a curved chin covering panel that extends from the front panel to a cup periphery at essentially an acute angle between 90 degrees and 45 degrees along the midline, at least one cup perforation through the chin covering panel;

a filter covering the at least one cup perforation;

a filter cover and contact rim covering the filter, the filter cover and the contact rim comprising at least one filter cover perforation that is in communication with the at least one cup perforation by way of the filter.

12. The passive transparent anti-contagion facemask of claim 11 further comprising a flexible flange configured to conform to a wearer's face.

13. The passive transparent anti-contagion facemask of claim 12, wherein the flexible flange is a lower durometer than the face covering cup.

14. The passive transparent anti-contagion facemask of claim 12, wherein the face covering cup is a unitary transparent element.

15. The passive transparent anti-contagion facemask of claim 12 further comprising two side cup panels joining the curved chin panel to a nose covering panel, the two side cup panels, the curved chin panel and the nose covering panel connected to the front panel on a first end and defining the cup periphery on a second end.

16. The passive transparent anti-contagion facemask of claim 12, wherein the at least one cup perforation is a slotted aperture defined by ribs.

17. A passive transparent anti-contagion facemask comprising:

a face covering cup comprising a front panel configured to provide an unobstructed view of a human mouth and human nostrils as viewed by an onlooker when the facemask is worn, a curved chin covering panel that extends from the front panel to a cup periphery, at least one cup perforation through the chin covering panel;

a filter covering the at least one cup perforation;

a filter cover and contact rim covering the filter, the filter cover and contact rim comprising at least on filter cover perforation that that is in communication with the at least one cup perforation by way of the filter.

18. The passive transparent anti-contagion facemask of claim 17 further comprising a flexible flange configured to conform to a wearer's face.

19. The passive transparent anti-contagion facemask of claim 17, wherein the face covering cup is essentially rigid.

20. The passive transparent anti-contagion facemask of claim 17 further comprising two side cup panels joining the curved chin panel to a nose covering panel, the two side cup panels, the curved chin panel and the nose covering panel connected to the front panel on a first end and defining the cup periphery on a second end.

* * * * *